US009533406B2

(12) United States Patent
Aoki

(10) Patent No.: US 9,533,406 B2
(45) Date of Patent: Jan. 3, 2017

(54) POWER TOOL

(71) Applicant: Yonosuke Aoki, Anjo (JP)

(72) Inventor: Yonosuke Aoki, Anjo (JP)

(73) Assignee: Makita Corporation, Anjo-shi (JP)

( * ) Notice: Subject to any disclaimer, the term of this patent is extended or adjusted under 35 U.S.C. 154(b) by 1103 days.

(21) Appl. No.: 13/644,669

(22) Filed: Oct. 4, 2012

(65) Prior Publication Data

US 2013/0081840 A1 Apr. 4, 2013

(30) Foreign Application Priority Data

Oct. 4, 2011 (JP) ..... 2011-219804
Oct. 4, 2011 (JP) ..... 2011-219908

(51) Int. Cl.
*B25F 5/00* (2006.01)
*B25D 17/26* (2006.01)
*B25D 11/12* (2006.01)

(52) U.S. Cl.
CPC ..... *B25D 17/26* (2013.01); *B25D 11/125* (2013.01); *B25D 2250/095* (2013.01); *B25D 2250/185* (2013.01)

(58) Field of Classification Search
CPC ..... B25F 5/00; B25D 17/26; B25D 2250/185; B25D 2216/0023
USPC ..... 173/2, 117, 170, 181, 201, 213, 216; 310/43, 90, 83, 157, 89, 275; 277/583
See application file for complete search history.

(56) References Cited

U.S. PATENT DOCUMENTS 7,032,683 B2 * 4/2006 Hetcher ..... B25D 11/005 173/1
7,410,009 B2 * 8/2008 Hirayama ..... B25F 5/00 173/104
7,413,026 B2 * 8/2008 Berghauser ..... B25D 17/08 173/109
7,814,986 B2 * 10/2010 Berghauser ..... B25D 17/08 173/109

(Continued)

FOREIGN PATENT DOCUMENTS

CN 1872498 A 12/2006
DE 27 09 616 9/1978

(Continued)

OTHER PUBLICATIONS

Jan. 14, 2013 European Search Report issued in EP 12 18 6341.

(Continued)

*Primary Examiner* — Andrew M Tecco
(74) *Attorney, Agent, or Firm* — Oliff PLC

(57) ABSTRACT

A power tool comprises a driving mechanism and a gear housing space (105*a*) which houses the driving mechanism. A lubricant is provided to the driving mechanism inside a gear housing (105). The driving mechanism includes a driving motor (110) having a motor shaft (111). The motor shaft (111) includes an inner communicating opening (191), an outer communicating opening (192) and an air passage (193) which connects the inner communicating opening (191) and the outer communicating opening (192). At least a part of the air passage (193) is arranged inside the motor shaft (111), and the passage (193) communicates with the gear housing space (105*a*) via the inner communicating opening (191) and also communicates with the outer space of the gear housing (105) via the outer communicating opening (192).

14 Claims, 12 Drawing Sheets

(56) References Cited

U.S. PATENT DOCUMENTS

| | | | | |
|---|---|---|---|---|
| 8,360,168 | B2 * | 1/2013 | Kakiuchi | B25D 17/245 173/104 |
| 8,522,890 | B2 * | 9/2013 | Abe | B25D 17/26 173/216 |
| 2007/0158091 | A1 * | 7/2007 | Hsu | B25F 5/00 173/217 |
| 2008/0006420 | A1 * | 1/2008 | Berghauser | B25D 17/08 173/117 |
| 2008/0245542 | A1 * | 10/2008 | Furusawa | B25D 16/006 173/201 |
| 2011/0030983 | A1 * | 2/2011 | Kakiuchi | B25D 17/245 173/46 |
| 2011/0155402 | A1 * | 6/2011 | Abe | B25D 17/26 173/48 |
| 2012/0255756 | A1 * | 10/2012 | Aoki | B24B 23/02 173/178 |

FOREIGN PATENT DOCUMENTS

| | | | | |
|---|---|---|---|---|
| DE | GB 2367780 | A * | 4/2002 | B25D 17/26 |
| EP | 0 589 337 | A1 | 3/1994 | |
| EP | 1872907 | A2 | 1/2008 | |
| EP | 2 130 651 | A1 | 12/2009 | |
| GB | 2 367 780 | A | 4/2002 | |
| JP | 2008-012662 | A | 1/2008 | |
| JP | A-2008-238301 | | 10/2008 | |
| JP | EP 2130651 | A1 * | 12/2009 | B25D 16/003 |
| JP | A-2011-093071 | | 2/2011 | |
| JP | A-2011-031363 | | 5/2011 | |
| JP | A-2006-334725 | | 12/2014 | |
| WO | WO 03/024671 | A2 | 3/2003 | |
| WO | WO 2011052451 | A1 * | 5/2011 | B25F 5/00 |

OTHER PUBLICATIONS

Feb. 9, 2015 Office Action issued in Chinese Application No. 201210376028.6.

Dec. 16, 2014 Office Action issued in Japanese Application No. 2011-219908.

Jul. 3, 2014 Office Action issued in Chinese Patent Application No. 201210376028.6 (with translation).

* cited by examiner

POWER TOOL

CROSS REFERENCE TO RELATED APPLICATION

The present application claims priority from Japanese Patent Application No. 2011-219908 filed on Oct. 4, 2011 and Japanese Patent Application No. 2011-219804 filed on Oct. 4, 2011, the disclosure of which is incorporated herein by reference in its entirety.

FIELD OF THE INVENTION

The invention relates to a power tool having a driving mechanism chamber.

BACKGROUND OF THE INVENTION

Japanese Unexamined Patent Application Publication No. 2011-031363 discloses a power tool having a housing space for a driving mechanism with lubricant, a passage for adjusting a pressure inside the housing space, and a filter chamber arranged in the passage, the filter chamber having a predetermined volume and a filter arranged therein. In a state that an inside air is exhausted in conjunction with the lubricant through the passage to the outside of the housing space while the pressure inside the housing space is increased, the lubricant is caught by the filter thereby the lubricant is prevented from out flowing to the outside of the housing space.

SUMMARY OF THE INVENTION

Problem to be Solved by the Invention

In the power tool described above, when a large amount of the lubricant passes through the passage, the filter is not able to catch whole amount of the lubricant. As a result, the lubricant may be outflowed to the outside of the housing space.

An object of the invention is, in consideration of the above described problem, to provide an improved technique to effectively regulate a lubricant outflowed from a predetermined housing space of a power tool.

Means for Solving the Problem

Above-mentioned object is achieved by the claimed invention. According to a preferable aspect of the invention, a power tool comprises a driving mechanism which actuates a tool, and a driving mechanism chamber, the driving mechanism chamber defining an inner space which houses the driving mechanism. A lubricant is provided for lubricating the driving mechanism in the inner space of the driving mechanism chamber. The driving mechanism includes a movable member having a movable shaft. The movable member includes a first opening, a second opening and a passage which connects the first opening and the second opening. At least apart of the passage is arranged inside the movable shaft, and the passage is adapted to communicate with the inner space of the driving mechanism via the first opening and further communicate with an outer space of the driving mechanism via the second opening. Further, at least a part of the driving mechanism may be arranged inside the driving mechanism chamber, of course whole part of the driving mechanism may be arranged inside the driving mechanism chamber.

According to this aspect, because the passage which connects the inner space and the outer space of the driving mechanism chamber is provided, the pressure inside the driving mechanism chamber is regulated to be high pressure. Further the passage is arranged at a part of the movable member thereby a position of the first opening is moved in conjunction with the movement of the movable member. Therefore the lubricant is more difficult to enter into the passage via the first opening than a component that the first opening is arranged on a member being not movable, that is the first opening is positioned ordinarily at one position. As a result, the lubricant is regulated to outflow to the outer space of the driving mechanism chamber.

According to a further preferable aspect of the invention, the movable member is defined as a rotational member having a rotational shaft, the rotational shaft being defined as the movable shaft. At least apart of the passage is arranged inside the rotational shaft.

According to this aspect, because the passage is arranged at the rotational member as the movable member, the position of the first opening changes in conjunction with a rotation of the rotational member. Therefore the lubricant is more difficult to enter into the passage via the first opening than a component that the first opening is arranged on a member being not rotatable.

According to a further preferable aspect of the invention, the passage connects to the first opening such that the passage extends in a radial direction of the rotational member. In this connection, the feature of which "the passage extends in a radial direction of the rotational member" means that the passage includes an extending directional component which includes the radial direction.

According to this aspect, the passage extends in the radial direction and connects to the first opening therefore the lubricant which is entered into the passage via the first opening is outflowed to the inner space of the driving mechanism chamber via the first opening by means of a centrifugal force in a stated that the rotational member is rotating. As a result, the lubricant is regulated to outflow to the outer space of the driving mechanism chamber.

According to a further preferable aspect of the invention, the passage connects to the second opening such that the passage extends in an axial direction of the rotational member. In this connection, the feature of which "the passage extends in an axial direction of the rotational member" means that the passage includes an extending directional component which includes the axial direction.

According to this aspect, the passage extends in the axial direction and connects to the second opening therefore the lubricant which is entered into the passage is difficult to outflow to the outer space of the driving mechanism chamber via the second opening by means of a centrifugal force in a stated that the rotational member is rotating. As a result, the lubricant is regulated to outflow to the outer space of the driving mechanism chamber.

According to a further preferable aspect of the invention, the passage is connects to the second opening such that the passage is arranged to include an axis line of the rotational shaft and to extend to be parallel to the axis line.

According to this aspect, in case that the passage extends in an axial direction of the rotational member and connects to the second opening, because the passage is arranged to include an axis line of the rotational shaft and to extend to be parallel to the axis line, the lubricant is more difficult to outflow to the outer space of the driving mechanism chamber via the second opening.

According to a further preferable aspect of the invention, the driving mechanism includes a motor, wherein the rotational shaft is defined by a driving shaft of the motor. Further the power tool comprises an outside communicating chamber which is provided at a distal end area of the driving shaft such that the outside communicating chamber is separated from the driving mechanism chamber and is communicated with the outside of the driving mechanism chamber. And also the second opening is arranged at a distal end of the driving shaft and is communicated with the outside communicating chamber.

According to this aspect, the passage is arranged at the driving shaft of the motor as the rotational member thereby a further member at which the passage is arranged is unnecessary.

According to a further preferable aspect of the invention, the driving mechanism includes a motor and a driven member which is driven by the motor, wherein the rotational member is defined by the driven member. Further the driven member is preferably defined by a crank shaft of a crank mechanism which converts a rotational motion of the driving shaft of the motor to a linear motion.

According to this aspect, the passage is arranged at the driven member which is driven by the motor as the rotational member. For example, the driven member may be defined by the crank shaft of the crank mechanism. Therefore, a further member at which the passage is arranged is unnecessary.

According to a further preferable aspect of the invention, the passage is provided with a plurality of chambers connected to one another.

According to this aspect, because the passage is provided with a plurality of chambers connected to one another, the lubricant entered into the passage is held at each chamber thereby the lubricant is regulated to outflow to the outer space of the driving mechanism chamber.

According to a further preferable aspect of the invention, the movable member is provided with an internal chamber located along the passage and configured to store a predetermined volume of lubricant while allowing pressurized gases from within the driving mechanism chamber to escape past the predetermined volume of lubricant via the second opening.

According to a further preferable aspect of the invention, the driving mechanism includes a motor and an electromagnetic clutch which is disposed between the motor and the tool. Further, the electromagnetic clutch is adapted to interrupt a power transmission from the motor to the tool based on a driving status of the power tool.

According to another preferable aspect of the invention, a power tool comprises a motor, a power transmission mechanism driven by the motor, the power transmission mechanism configured to rotationally drive a tool, a driving mechanism chamber which houses the power transmission mechanism and a lubricant provided inside the driving mechanism chamber. The power transmission mechanism includes an electromagnetic clutch configured to transmit power and interrupt a power transmission from the motor based on a driving status of the power tool. The "status of the power tool" of the invention typically represents that, for example, in case the power tool is defined as a hammer drill, a status corresponds that whether a bit is caught by a workpiece or not causing the hammer drill being swung around a longitudinal direction of the bit or not. Further, for example in case the power tool is defined as a circular saw, a status corresponds that whether a blade is caught by a workpiece or not causing the circular saw being rebounded in a direction opposed to a sawing direction of the blade.

Further the electromagnetic clutch is provided with a driving rotational member and a driven rotational member configured to rotate about a clutch axis. The electromagnetic clutch is adapted to transmit power by engaging the driving rotational member and the driven rotational member to each other and to interrupt the power transmission by cancelling an engagement among the driving rotational member and the driven rotational member. Further, the power tool has a sealing member which separates an engagement region of the driving rotational member and the driven rotational member from the lubricant inside the driving mechanism chamber. The "engagement region" typically represents a region in which a friction surface of the driving rotational member and the driven rotational member are arranged. The friction surface described above preferably includes a flat surface and a conical surface.

According to this, invention, because the power tool has a sealing member which separates the engagement region of the driving rotational member and the driven rotational member, the engagement region is protected against the lubricant. As a result, the electromagnetic clutch is provided inside the driving mechanism chamber including the lubricant therein.

According to a further preferable aspect of the invention, the electromagnetic clutch includes an input shaft to which power of the motor is inputted. Further, input shaft is provided as another shaft from a motor shaft of the driving motor, and defined as an intermediate shaft which is arranged between the motor shaft and the tool.

According to a further preferable aspect of the invention, the electromagnetic clutch includes an input shaft to which power of the motor is inputted and an output shaft which outputs the power toward the tool. The input shaft and the output shaft are arranged coaxially. Further, both of a power input part which inputs the power to the input shaft and a power output part which outputs the power from the output shaft are arranged at one side of a line perpendicular to an axial line of the input shaft and the output shaft with respect to the engagement region. In this connection, features that the output shaft being arranged at the inside of the input shaft with respect to a radial direction of the input shaft, and that the output shaft being arranged at the outside of the input shaft with respect to a radial direction of the input shaft, are preferably constructed in the invention.

According to this aspect, a size of the power tool with respect to the axial line is downsized, further each component of the power tool is rationally arranged.

According to a further preferable aspect of the invention, the sealing member is arranged at a position between the input shaft and the output shaft, as well as at a position between one component being arranged at an outside position among the input shaft and the output shaft and an inside wall of the driving mechanism chamber. The "inside wall of the driving mechanism chamber" is preferably constructed by a cylindrical wall protruding from a wall of the driving mechanism chamber such that the cylindrical wall surrounds the engagement region with respect to the axial line. Further, the sealing member is arranged between a distal end of the cylindrical wall and a periphery of the one component being arranged at the outside position.

According to this aspect, the engagement region is separated from the lubricant provided inside the driving mechanism chamber by the sealing member.

According to a further preferable aspect of the invention, the electromagnetic clutch has a field which houses an electromagnetic coil therein. The sealing member arranged between the one component and the inside wall is adapted to prevent the field from rotating with the electromagnetic clutch while the electromagnetic clutch is transmitting the power.

According to this aspect, because the sealing member seals the engagement region as well as prevents the field from rotating, a further member to prevent the field from rotating with the electromagnetic clutch is unnecessary thereby the number of parts is reduced effectively.

According to a further preferable aspect of the invention, the tool is defined as a bit being elongated and being rotatable around a longitudinal direction of the bit. The electromagnetic clutch is adapted to prevent the power tool from being swung inadvertently around the longitudinal direction by interrupting the power transmission in a state that the bit is locked by a workpiece. In this case, the electromagnetic clutch is preferably adapted to interrupt the power transmission in a state that a torque applying to the bit and/or a velocity or an acceleration applying to a body of the power tool is not less than a predetermined threshold.

According to the invention, a technique to effectively regulate a lubricant outflowed from a predetermined housing space of a power tool is provided.

Other objects, features and advantages of the invention will be readily understood after reading the following detailed description together with the accompanying drawings and the claims.

DESCRIPTION OF THE PREFERRED EMBODIMENTS

Each of the additional features and method steps disclosed above and below may be utilized separately or in conjunction with other features and method steps to provide and manufacture improved power tools and method for using such the power tools and devices utilized therein. Representative examples of the invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

(First Embodiment)

Figure 1:
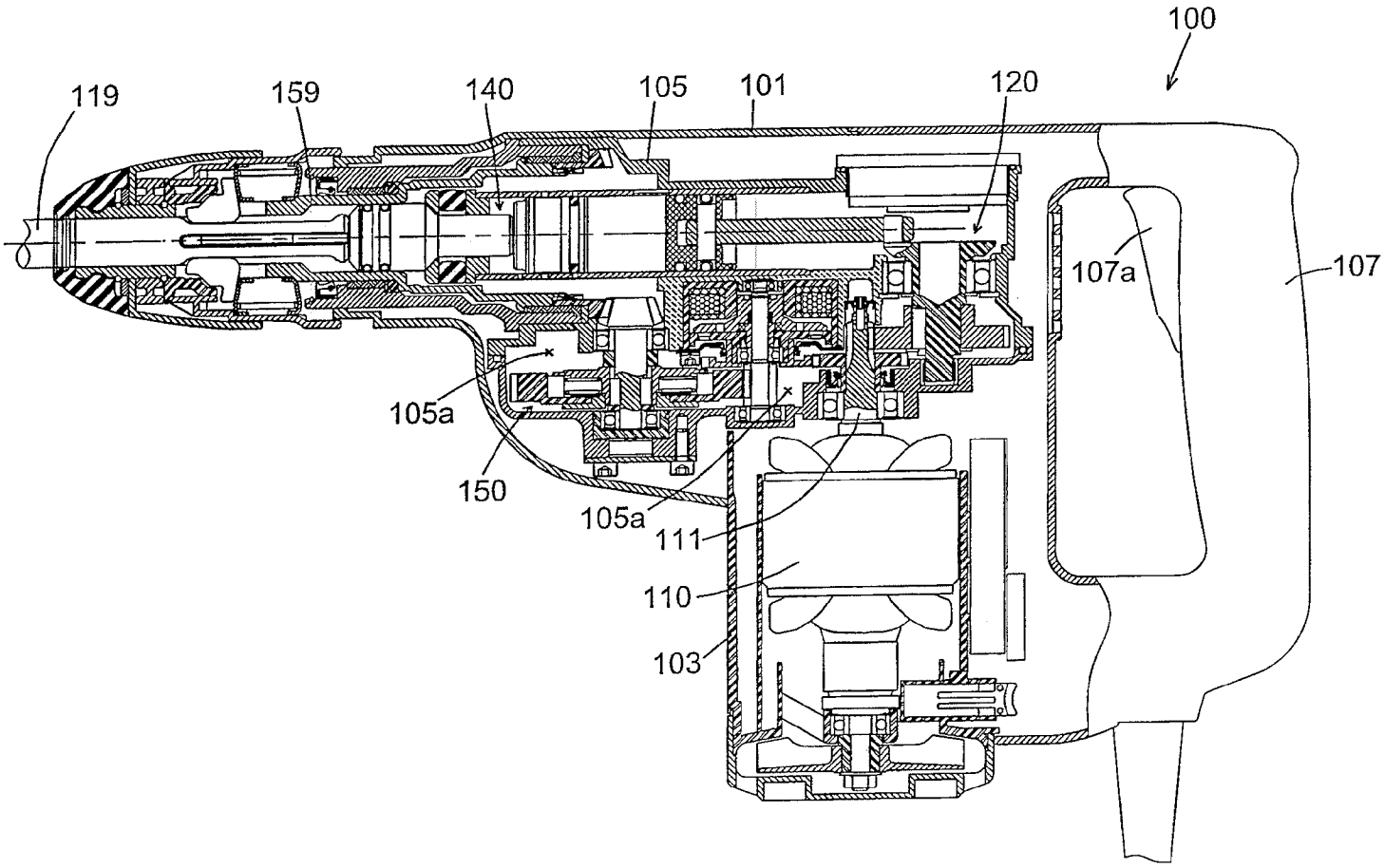
FIG. 1 shows a cross-sectional view of a total composition of a hammer drill in accordance with a first embodiment of the invention.
Figure 2:
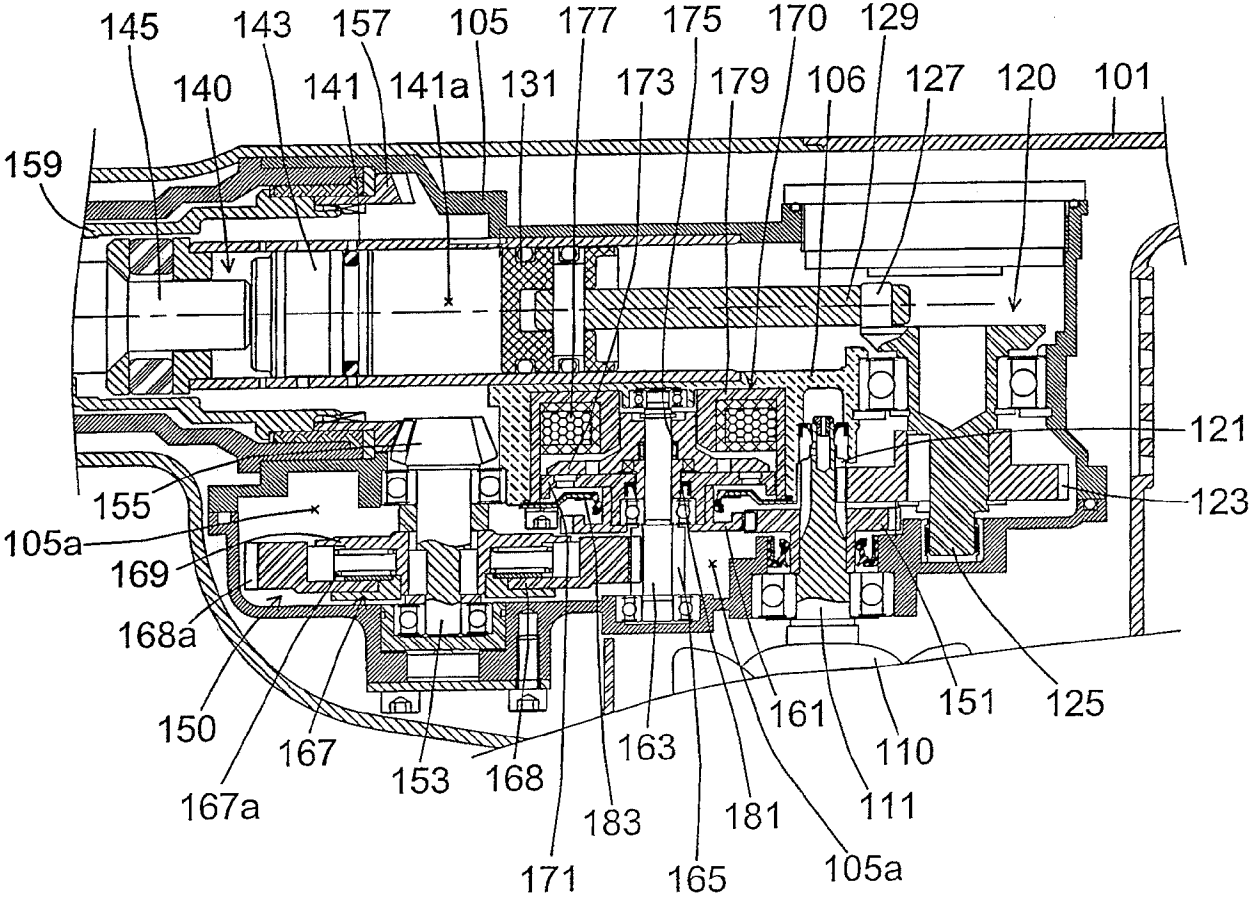
FIG. 2 shows an enlarged cross-sectional view of a main part of the hammer drill.

A first embodiment of the invention will be explained with reference to FIG. 1 to FIG. 3. In this embodiment, an electrical hammer drill as one example of a power tool of the invention is utilized to explain. As shown in FIG. 1 and FIG. 2, a hammer drill 100 according to this embodiment is typically provided with a body 101 as a tool body, which forms an outline of the hammer drill 100. A hammer bit 119 is detachably attached to a front portion (left side of FIG. 1) of the body 101 via a cylindrical tool holder 159. The hammer bit 119 is attached to be relatively movable against the tool holder 159 in a longitudinal direction, and to be rotated integrally with the tool holder 159 in a circumferential direction. A hand grip 107 which is held by a user is disposed at an opposite side from the front portion of the body 101. The hammer bit 119 is one example of a feature corresponding to "a tool" of the invention. Further, for convenience of explanation, a side at which the hammer bit 119 is disposed is called a front side and a side at which the hand grip 107 is disposed is called a rear side of the hammer drill 100.

The body 101 is provided with a motor housing 103 which houses a driving motor 110, and a gear housing 105 which houses a motion converting mechanism 120, an impact element 140 and a power transmission mechanism 150, and a body housing. The driving motor 110 is disposed such that a rotational axis of a motor shaft 111 fits with a vertical direction (a vertical direction of FIG. 1) which is substantially perpendicular to a longitudinal direction of the body 101 (a longitudinal direction of the hammer bit 119). Therefore, a tip part of the motor shaft 111 is arranged inside the gear housing 105, and a body of the driving motor 110, especially a connecting portion (herein called an electrical contact) to which a current providing portion provides a current is arranged outside the gear housing and inside the body housing. A torque of the driving motor 110 is arbitrarily converted to a liner motion by the motion converting mechanism 120 and transmitted to the impact element 140. An impact force in the longitudinal direction of the hammer bit 119 is generated by a liner motion of the impact element 140. The driving motor 110 is one example of a feature arbitrarily corresponding to "a movable member", "a rotational member" or "a motor" of the invention. The motor shaft 111 is one example of a feature arbitrarily corresponding to "a movable shaft", "a rotational shaft" of "a driving shaft" of the invention.

Further, the torque of the driving motor 110 is arbitrarily decelerated by the power transmission mechanism 150 and transmitted to the hammer bit 119 via the tool holder 159.

Therefore, the hammer bit 119 is rotated in the circumferential direction. The driving motor 110 is driven when a trigger 107*a* disposed on the hand grip 107 is pulled.

As shown in FIG. 2, the motion converting mechanism 120 is mainly provided with a first driving gear 121, a driven gear 123 and a crank mechanism. The first gear 121 is disposed on the motor shaft 111 of the driving motor 110. The driven gear 123 is adapted to mate and engage with the first driving gear 121. The crank mechanism is mainly provided with a crank shaft 125, an eccentric shaft 127, a piston 131 and a connecting rod 129. The crank shaft 125 is adapted to rotate integrally with the driven gear 123. The eccentric shaft 127 is located at an eccentric position from an axis line of the crank shaft 125. The connecting rod 129 connects the piston 131 and the eccentric shaft 127. Bothe end part of the crank shaft 125 is supported on the gear housing 105 by two bearing 124*a*, 124*b* so as to be rotatable. The piston 131 is disposed as a driving member which actuates the impact element 140. The piston 131 is arranged such that the piston 131 is slidable inside a cylinder 141 in the longitudinal direction of the hammer bit 119. The motor shaft 111 of the driving motor 110 and the crank shaft 125 are disposed to be parallel to each other. Further, a longitudinal direction of the driving motor 110 and a longitudinal direction of the cylinder 141 are disposed to be perpendicular to each other. The cylinder 141 is fixed on the gear housing 105.

The impact element 140 is mainly provided with a striker 143 and an impact bolt 145. The striker 143 as an impact member is disposed to be slidable inside the cylinder 141. The impact bolt 145 is disposed as an intermediate member which transmits a kinetic energy of the striker 143 to hammer bit 119. An air chamber 141*a* which is formed to be surrounded by the cylinder 141, the piston 131 and the striker 143 is disposed inside the cylinder 141. The striker 143 is driven by a pressure fluctuation (air spring) of the air chamber 141*a*, which is caused by a sliding motion of the piston 131. The striker 143 impacts and strikes the impact bolt 145 and transmits the impact force to the hammer bit 119 via the impact bolt 145.

The power transmission mechanism 150 is mainly provided with a second driving gear 151, a first intermediate gear 161, a first intermediate shaft 163, an electromagnetic clutch 170, a second intermediate shaft 165, a mechanical torque limiter 167, a second intermediate shaft 153, a small bevel gear 155, a large bevel gear 157 and the tool holder 159. The power transmission mechanism 150 is adapted to transmit a torque of the driving motor 110 to the hammer bit 119. The tool holder 159 is a substantially cylindrical-shaped member. The tool holder 159 is held on the gear housing 105 and is rotatable around the longitudinal direction of the hammer bit 119. The second driving gear 151 is fixed on the motor shaft 111 of the driving motor 110 and rotated by the driving motor 110. The first intermediate shaft 163 and the second intermediate shaft 153, which are disposed at a downstream area with respect to the transmission of the torque, are disposed so as to be parallel to the motor shaft 111. The first intermediate shaft 163 is supported on the gear housing 105 rotatably by two bearing which supports an upper end portion and a lower end portion of the first intermediate shaft 163. Further, the second intermediate shaft 153 is supported on the gear housing 105 rotatably by two bearing 154*a*, 154*b*. The first intermediate shaft 163 is disposed as a shaft for the electromagnetic clutch. The first intermediate shaft 163 is driven by the first intermediate gear 161 which always meshes with the second driving gear 151 via the electromagnetic clutch 170. Further, a gear ratio between the first intermediate gear 161 and the second driving gear 151 is defined such that a rotational velocity of the first intermediate gear 161 is decelerated against a rotational velocity of the second driving gear 151.

The electromagnetic clutch 170 is disposed between the driving motor 110 and the hammer bit 119, for more detail between the motor shaft 111 and the second intermediate shaft 153, and is adapted to transmit the toque and to interrupt the transmission of the torque. In case that the hammer bit 119 is caught and locked by a workpiece during the hammer drill operation, the electromagnetic clutch 170 is adapted to prevent the body 101 from swinging by an inadvertent reaction torque (a torque in an opposite direction against the rotational direction of the hammer bit 119) exerted on the body 101. The electromagnetic clutch 170 is disposed at an upper area of the first intermediate gear 161 in the longitudinal direction of the first intermediate shaft 163.

The electromagnetic clutch 170 is a clutch utilizing a friction force. The electromagnetic clutch 170 is mainly provided with a disk-shaped driving clutch member 171, a disk-shaped driven clutch member 173, a spring 175, an electromagnetic coil 177, and a coil housing member 179 which houses the electromagnetic coil 177. The driving clutch member 171 and the driven clutch member 173 are disposed such that the driving clutch member 171 and the driven clutch member 173 face to each other. The driving clutch member 171 and the driven clutch member 173 are relatively movable to each other in the longitudinal direction of the first intermediate shaft 163. Further, when the current is provided to the electromagnetic coil 177, the driving clutch member 171 and the driven clutch member 173 are moved to be close and to each other by an electromagnetic force, then the driving clutch member 171 and the driven clutch member 173 contact with each other, thereby a torque is transmitted by the friction force of the contact face. When the provision of the current is stopped, a contact among the driving clutch member 171 and the driven clutch member 173 is canceled by the biasing force of the spring 175, thereby the transmission of the torque is interrupted.

The torque outputted from the electromagnetic clutch 170 is transmitted to the second intermediate shaft 153 via the mechanical torque limiter 167. The mechanical torque limiter 167 is disposed as a safety mechanism for protecting the hammer bit 119 against overload. Namely, in case that a large torque exceeding the designed value (hereinafter called the maximum transmission torque value) is exerted on the hammer bit 119, the mechanical torque limiter 167 interrupts the transmission of the torque to the hammer bit 119. The mechanical torque limiter 167 is disposed so as to be coaxially to the second intermediate shaft 153.

The mechanical torque limiter 167 is mainly provided with a driving member 168 having a third intermediate gear 168*a* which meshes with the second intermediate gear 165, a driven member 169 which rotates integrally with the second intermediate shaft 153. In case that a value of the torque exerted on the second intermediate shaft 153 corresponding to a value of the torque exerted on the hammer bit 119 is less than the maximum transmission torque value which is defined by the biasing force of the spring 167*a*, the torque is transmitted between the driving member 168 and the driven member 169. On the other hand, in a case that the value of the torque exerted on the second intermediate shaft 153 exceeds the maximum transmission torque value, the transmission of the torque between the driving member 168 and the driven member 169 is interrupted. Further, a gear ratio between the third intermediate gear 168*a* of the driving member 168 and the second intermediate gear 165 is defined such that a rotational velocity of the third intermediate gear 168*a* is decelerated against a rotational velocity of the second intermediate gear 165.

The torque transmitted to the second intermediate gear 153 is transmitted from a small bevel gear 155 which is disposed integrally with the second intermediate shaft 153 to a large bevel gear 157 which meshes with the small bevel gear 155. The torque transmitted to the large bevel gear 157 is transmitted to the hammer bit 119 via the tool holder 159 which connected with the large bevel gear 157.

The motion converting mechanism 120, the impact element 140, and the tip portion of the motor shaft 111 of the driving motor 110 are housed in the gear housing 105. Namely, these components are disposed at a gear housing space 105*a* which is surrounded hermetically by the gear housing 105. At the gear housing space 105, a lubricant for lubricating the motion converting mechanism 120, the impact element 140 and the power transmission mechanism 150 is provided. The gear housing space 105*a* is one example of a feature corresponding to "a driving mechanism chamber" of the invention. The motion converting mechanism 120, the impact element 140, the power transmission mechanism 150 and the driving motor 110 are one example of a feature corresponding to "a driving mechanism" of the invention.

Since the electromagnetic clutch 170 transmits the torque by means of the friction force of the contract face among the driving clutch member 171 and the driven clutch member 173, incase that the lubricant adheres to the contact face, the torque transmission ability is failed by a slipping of the contact face. Therefore, in this embodiment, a clutch housing space which is divided from the gear housing space 105 is provided in the gear housing space 105, and the electromagnetic clutch 170 is arranged at the clutch housing space. Further, a first oil sealing member 181 and a second oil sealing member 183 are disposed for preventing the lubricant from entering into the clutch housing space.

The hammer drill 100 described above, the driving motor 110 is driven when the trigger 107*a* is triggered. The torque of the driving motor 110 is transmitted to the motion converting mechanism 120, and the piston 131 is moved linearly along the cylinder 141. Therefore, the striker 143 is slid linearly inside the cylinder 141 by means of a pressure fluctuation of the air inside the air chamber 141*a* i.e. an air spring of the air. The striker 143 strikes the impact bolt 145, thereby the kinetic energy is transmitted to the hammer bit 119.

On the other hand, the torque of the driving motor 110 is transmitted to the power transmission mechanism 150. Therefore, the tool holder 159 is rotated and the hammer bit 119 is rotated integrally with the tool holder 159. In this way, the hammer bit 119 actuates a hammer operation in the longitudinal direction of the hammer bit 119 and a drill operation in the circumferential direction of the hammer bit 119, thereby the hammer drill 100 performs a hammer drill operation to a workpiece.

Further, beside the hammer drill operation which is combination with the hammer operation and the drill operation, the hammer drill 100 according to this embodiment performs the drill operation, as well as the hammer operation by switching the operation mode. However, a switching mechanism between the operations is omitted for convenience of explanation.

When the hammer drill 100 is working, since the driving of the driving mechanism such as the motion converting mechanism 120, the impact element 140, the power transmission mechanism 150 and so on generates heat, the pressure inside the gear housing space 105*a* is increased. Therefore, it is necessary to avoid increasing the pressure inside the gear housing space 105*a* by communicating the air inside the gear housing space 105 to the outside. On the other hand, because the lubricant for lubricating the driving mechanism is provided at the gear housing space 105*a*, in case that a simple through-hole which penetrates the gear housing 105 is formed on the gear housing 105, the lubricant may be flowed out from the gear housing 105. Therefore, in this embodiment, as shown in FIG. 3, an air communicating part 190 which communicates the gear housing space to outside is provided inside the gear housing space 105*a* at a tip portion of the motor shaft 111 of the driving motor 110.

Figure 3:
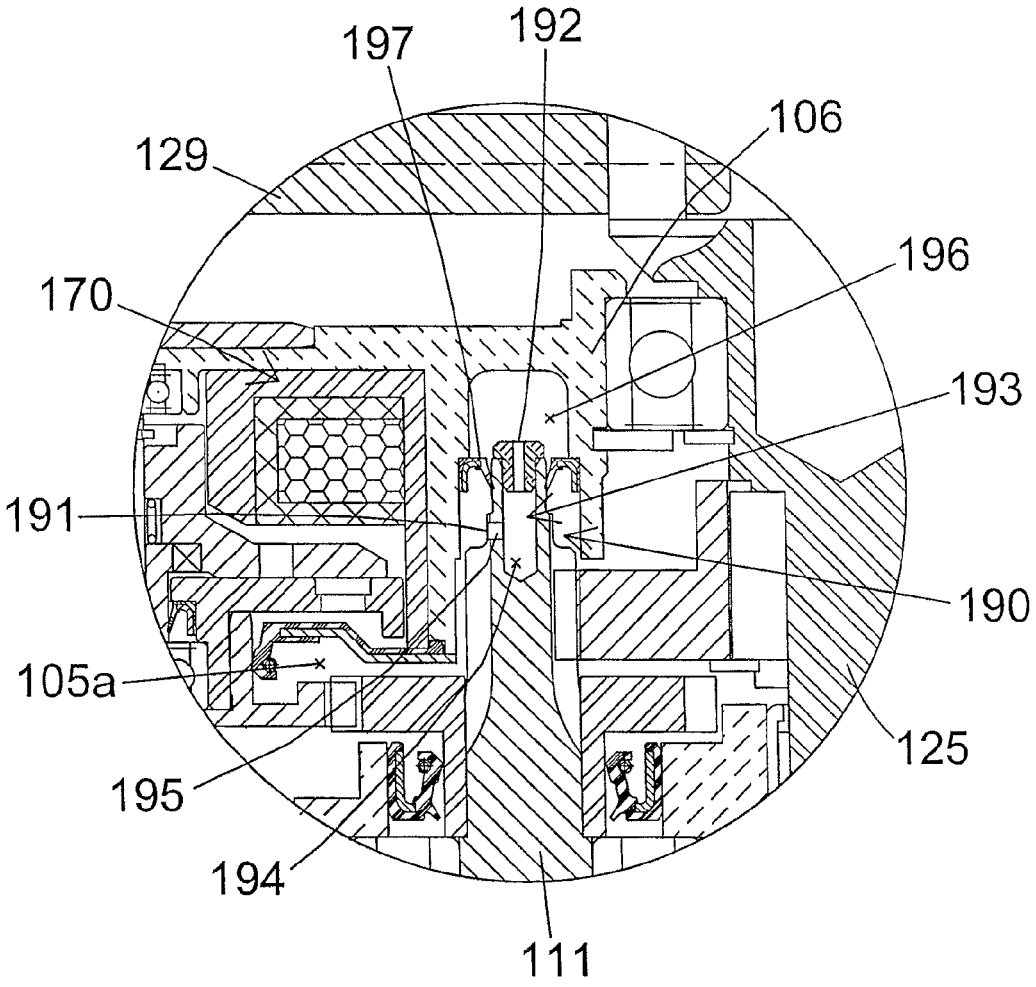
FIG. 3 shows an enlarged cross-sectional view around a driving shaft of a motor.

As shown in FIG. 3, the air communicating part is mainly provided with an inner communicating opening 191, an outer communicating opening 192 and an air passage 193. The inner communicating opening 191 is formed at a side surface of the motor shaft 111. The outer communicating opening 192 is formed at a distal end of the motor shaft 111. Further, the air passage 193 is formed inside the motor shaft 111.

The air passage 193 is provided with a axially extending part 194 and a radially extending part 195. The axially extending part 194 is disposed at the axis center of the motor shaft 111 and is adapted to extend in the axial direction of the motor shaft 111. The radially extending part 195 is disposed so as to extend in the radial direction of the motor shaft 111, and the radially extending part 195 is adapted to connect a central part of the axially extending part 194 with respect to the axial direction of the motor shaft 111 and the inner communicating opening 191. Namely, the air passage 193 is communicated with the inner communicating opening 191 via the radially extending part 195, and further communicated with the outer communicating opening 192 via the axially extending part 192. Therefore the inner communicating opening 191 and the outer communicating opening 192 are communicated with each other. The inner communicating opening 191, the outer communicating opening 192, the air passage 193 are one example of features corresponding to "a first opening", "a second opening", "a passage" of the invention respectively.

A cylindrical outer air communicating chamber 196 which communicates with outside of the gear housing 105, is provided at the tip part of the motor shaft 111 (upper end in FIG. 3). Namely, a third oil sealing member 197 is disposed between an inner housing portion 106 and the motor shaft 111, the inner housing portion 106 and the third oil sealing member 197 form the outer air communicating chamber 196. The third oil sealing member 197 is provided with a combination of a metal ring and a rubber, and is formed as a ring-shaped member. The third oil sealing member 197 is disposed and fixed such that the metal ring is pressed into an inner wall of the inner housing portion 106. On the other hand, the third oil sealing member 197 is disposed to be tightly sealed to the motor shaft 111 by the elasticity of the internal side rubber of the third oil sealing member 197. The outer air communicating chamber 196 is communicated with the outside air through a through-hole (not shown) which is formed on the gear housing 105. The tip portion of the motor shaft 111 is disposed at the outer air communicating chamber 196 thereby the outer communicating opening 192 is communicated with the outside air.

According to the first embodiment described above, since the air communicating part 190 is provided, the gear housing space 105*a* communicates with outside of the gear housing 105. Therefore, the pressure of the gear housing space 105*a* is avoided from being high-pressure because of the heat generated by the driving of the driving mechanism comprising the motion converting mechanism 120, the impact element 140, and the power transmission mechanism 150 and so on.

Further, according to the first embodiment, the air communicating part 190 is disposed in the motor shaft 111 of the driving motor 110. Since the air communicating part 190 is disposed on the motor shaft 111 as a rotating member, in comparison with a power tool in which the air communicating part 190 is disposed on a member not being rotatable, the lubricant is not flowed into the air communicating part 190 easily. Namely, being accompanied with the rotation of the motor shaft 111, the position of the inner communicating opening 191 is changed. Therefore, in comparison with a power tool in which the inner communicating opening 191 is not changed, the lubricant is not flowed into the air passage 193 through inner communicating opening 191 easily. Accordingly, by providing the inner communicating opening 191 on the motor shaft 111 being rotatable, the lubricant is prevented from entering into the air communicating part 190. As a result, the lubricant is prevented from flowing out to the outside of the gear housing space 105*a*.

Further, according to the first embodiment, the air passage 193 is disposed such that the radially extending part 195 which extends in the radial direction of the motor shaft 111 connects to the inner communicating opening 191. Therefore, in case that the lubricant flows into the air passage 193 through the inner communicating opening 191, the lubricant is forced to be returned into the gear housing space 105*a* through the inner communicating opening 191 by means of a centrifugal force caused by the rotation of the motor shaft 111. As a result, the lubricant is prevented from flowing out to the outside of the gear housing space 105*a*.

Further, according to the first embodiment, the air passage 193 is disposed such that the axially extending part 194 which extends in the axial direction of the motor shaft 111 connects to the outer communicating opening 192. Therefore, in case that the lubricant flows into the air passage 193 through the inner communicating opening 191, a centrifugal force caused by the rotation of the motor shaft 111 don't make the lubricant move toward the outer communicating opening 192 in the axially extending part 194. Namely, the lubricant is held in the axially extending part 194. Especially, such construction is more effective for the power tool in which the axially extending part 194 includes the rotational axis of the motor shaft 111 and extends to be parallel to the rotational axis. As a result, the lubricant is prevented from flowing out to the outside of the gear housing space 105*a*.

Further, according to the first embodiment, the radially extending part 195 is disposed so as to extend from the side surface of the substantially center part of the axially extending part 194 which extends in the longitudinal direction of the motor shaft 111 to the inner communicating opening 191 in the radial direction of the motor shaft 111. Namely, a lubricant holding portion is formed at one end of the axially extending part 194, the one end being is opposite to the outer communicating part 192. Therefore, in case that the lubricant flows into the axially extending part 194, the lubricant is held in the lubricant holding portion thereby the lubricant is prevented from flowing out to the outside of the gear housing space 105*a*.

Further, according to the first embodiment, the air communicating part 190 is disposed on the motor shaft 111 of the driving motor 110. Therefore, it is not necessary to add another rotational element on which the air communicating part 190 is disposed, namely existing rotational member is utilized to provide the air communicating part 190.

In the first embodiment described above, the air communicating part 193 is not limited to be provided with the axially extending part 194 and the radially extending part 195. For example, the air communicating part 193 may be provided with the axially extending part 193, the radially extending part 194 and a lubricant holding part which is disposed between the axially extending part 193 and the radially extending part 194, the lubricant holding part holding the lubricant. Or an inner space of the axially extending part 193 and/or the radially extending part 194 may be divided into a plurality chambers. Further, the axially extending part 193 is not limited to include the rotational axis line of the motor shaft 111, namely the axially extending part 193 may be disposed at an eccentric position which is eccentric to the rotational axis line. Further, the axially extending part 193 may be inclined to the rotational axis line.

(Second Embodiment)

Figure 4:
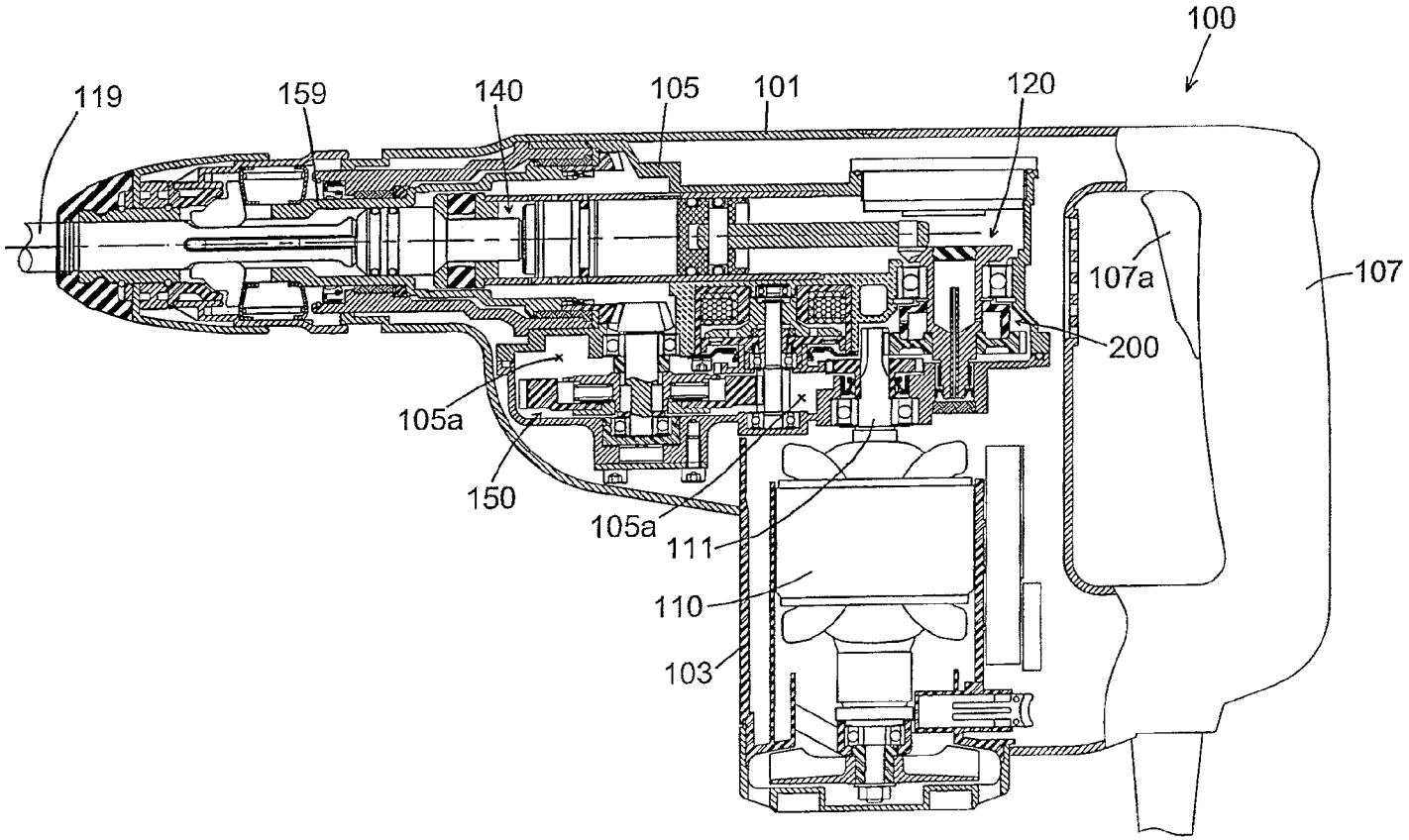
FIG. 4 shows a cross-sectional view of a total composition of a hammer drill in accordance with a second embodiment of the invention.
Figure 5:
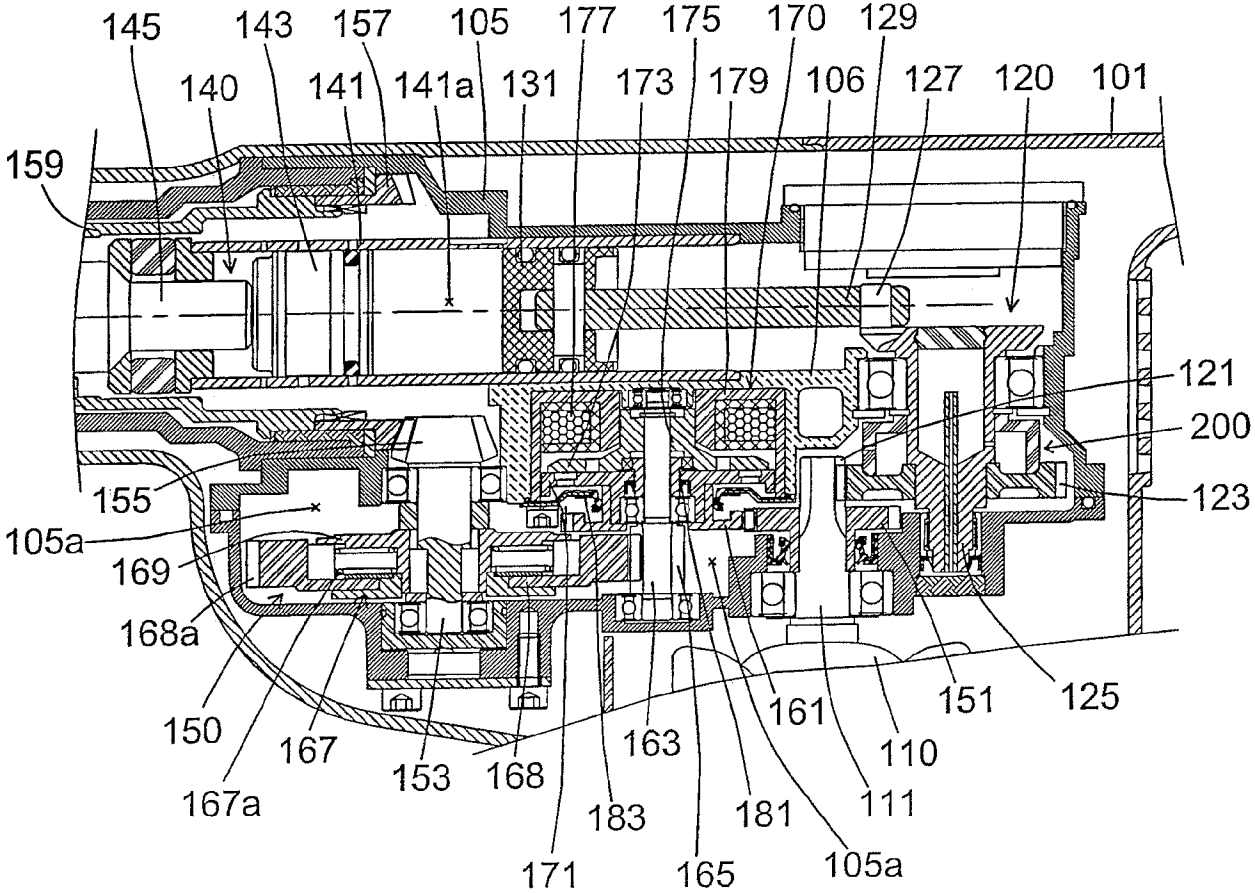
FIG. 5 shows an enlarged cross-sectional view of a main part of the hammer drill in accordance with the second embodiment.

A second embodiment of the invention will be explained with reference to FIG. 4 to FIG. 6. The composition except an air communicating part is similar to the composition of the first embodiment, therefore the composition is signed same number as the first embodiment and the explanation of the composition is omitted. As shown in FIG. 4 and FIG. 5, in the second embodiment, an air communicating part 200 is disposed on the crank shaft 125 of the motion converting mechanism 120.

Figure 6:
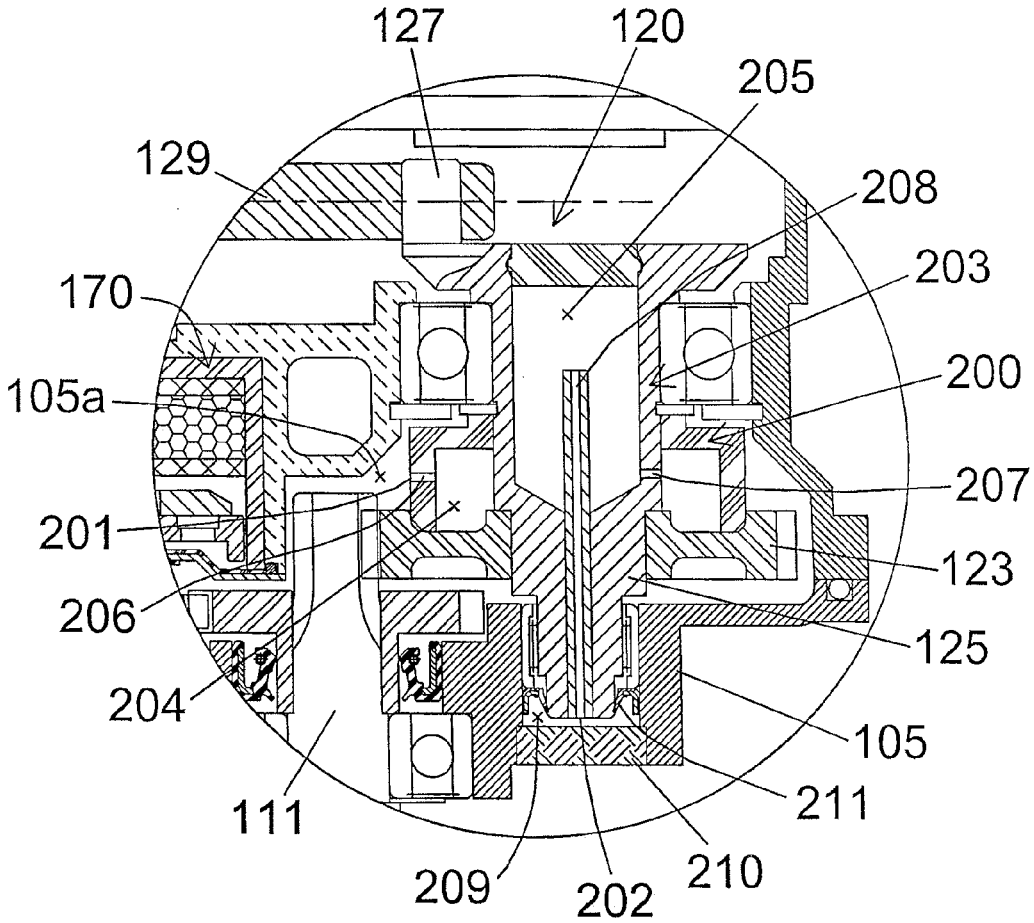
FIG. 6 shows an enlarged cross-sectional view around a motion converting mechanism.

As shown in FIG. 6, the air communicating part 200 is mainly provided with an inner communicating opening 201, an outer communicating opening 202, and an air passage 203. The inner communicating opening 201 is disposed on the side surface of the crank shaft 125. The outer communicating opening 202 is disposed on the lower end of the crank shaft 125 with respect to the rotational axis line of the crank shaft 125. Further, the air passage 203 is disposed in the crank shaft 125. The air passage 203 is mainly provided with a first chamber 204, a second chamber 205, a first passage 206, a second passage 207, and a third passage 208. The crank shaft 125 and the driven gear 123 which rotate integrally with the air passage 203 is one example of a feature corresponding to "a movable member", "a rotational member", a driven member" of the invention respectively. The crank shaft 125 is one example of a feature corresponding to "a movable shaft", "a rotational shaft", "a crank shaft" of the invention respectively.

The first chamber 204 is disposed such that the first chamber 204 is surrounded by the crank shaft 125 and the driven gear 123. The first passage 206 is disposed at a periphery of the first chamber 204 so as to extend in the radial direction of the crank shaft 125. The first chamber 204 is connected to the inner communicating opening 201 via the first passage 204. The second chamber 205 is disposed in the crank shaft 125 so as to extend in the rotational axis of the crank shaft 125. The first chamber 204 and the second chamber 205 are connected to each other via the second passage 207 which extends in the radial direction of the crank shaft 125. The third passage 208 is disposed as a sleeve shaped member at the central part of the crank shaft 125 so as to protrude to the second chamber 205. The third passage 208 is disposed such that the third passage extends in parallel with the rotational axis of the crank shaft 125. The second chamber 205 is connected to the outer communicating opening 202 via the third passage 208.

Since the air passage 203 is disposed described above, the inner communicating opening 201 and the outer communicating opening 202 are connected to each other via the inner space of the crank shaft 125. The inner communicating opening 201, the outer communicating opening 202, and the air passage 203 are one example of a feature corresponding to "a first opening", "a second opening", and "a passage" of the invention respectively. Further, the first chamber 204 and the second chamber 205 are one example of a feature corresponding to "a plurality of chambers" on the invention.

An outer air communicating chamber 209 formed as a cylinder is disposed at a lower area of the crank shaft 125, the outer communicating chamber 209 communicating with the outer air via a filter 210. Namely, a fourth oil sealing member 211 is disposed between the crank shaft 125 and the gear housing 105 which holds the crank shaft 125, thereby a wall of the gear housing 105, the fourth oil sealing member 211, and the filter 210 form the outer air communicating chamber 209. The fourth oil sealing member 211 is with a combination of a metal ring and a rubber, and is formed as a ring-shaped member. The fourth oil sealing member 211 is disposed and fixed such that the metal ring is pressed into an inner wall of the gear housing 105. On the other hand, the fourth oil sealing member 211 is disposed to be tightly sealed to the crank shaft 125 by the elasticity of the internal side rubber of the fourth oil sealing member 211. The outer communicating opening 202 opens toward the outer air communicating chamber 209 thereby the outer communicating opening 202 communicates with the outside of the gear housing 105.

According to the second embodiment described above, since the air communicating part 200 is provided, the gear housing space 105*a* communicates with outside of the gear housing 105. Therefore, the pressure of the gear housing space 105*a* is avoided from being high-pressure because of the heat generated by the driving of the driving mechanism comprising the motion converting mechanism 120, the impact element 140, and the power transmission mechanism 150 and so on.

Further, according to the second embodiment, since the air communicating part 200 is disposed in the crank shaft 125, in accompany with the rotation of the crank shaft 125 and the driven gear 123, the position of the inner communicating opening 201 is changed, thereby the lubricant is prevented from entering into the air communicating part 200. As a result, the lubricant is prevented from flowing out to the outside of the gear housing space 105*a*.

Further, according to the second embodiment, the air passage 203 connects to the inner communicating opening 201 through the first passage 206 which extends in the radial direction of the crank shaft 125. Therefore, in case that the lubricant flows into the air passage 203 through the inner communicating opening 201, the lubricant is forced to be returned into the gear housing space 105*a* through the inner communicating opening 201 by means of a centrifugal force caused by the rotation of the crank shaft 125 and the driven gear 123. As a result, the lubricant is prevented from flowing out to the outside of the gear housing space 105*a*.

Further, according to the second embodiment, the air passage 203 is disposed such that the third passage 208 which extends in the axial direction of the crank shaft 125 connects to the outer communicating opening 202. Therefore, in case that the lubricant flows into the air passage 203 through the inner communicating opening 201, a centrifugal force caused by the rotation of the crank shaft 125 don't make the lubricant move toward the outer communicating opening 202. Namely, the lubricant is held in the air passage 203, i.e. the first chamber 204 and/or the second chamber 205. Especially, such construction is more effective for the power tool in which the third passage 208 includes the rotational axis of the crank shaft 125 and extends to be parallel to the rotational axis. As a result, the lubricant is prevented from flowing out to the outside of the gear housing space 105*a*.

Further, according to the second embodiment, the third passage 208 is disposed to protrude into the second chamber 205. Therefore, a lubricant holding portion which holds the lubricant is formed in the second chamber 205. Accordingly, in case that the lubricant flows into the second chamber 205, the lubricant is held in the lubricant holding portion thereby the lubricant is prevented from flowing into the third passage 208. As a result, the lubricant is prevented from flowing out to the outside of the gear housing space 105*a*.

Further, according to the second embodiment, the air passage 203 is provided with a plurality of chambers such as the first chamber 204 and the second chamber 205 such that the first chamber 204 and the second chamber 205 connect to each other. Therefore, the lubricant is not moved to the third passage 208 easily. In addition, since the third passage 208 is disposed at the central part of the crank shaft 125, the lubricant is prevented from reaching at the third passage 208 by means of a centrifugal force caused by the rotation of the crank shaft 125.

Further, according to the second embodiment, the air communicating part 200 is disposed on the crank shaft 125. Therefore, it is not necessary to add another rotational member on which the air communicating part 200 is disposed, namely existing rotational member is utilized to provide the air communicating part 200.

In the second embodiment described above, the air passage 203 is provided with two chambers, however the air passage 203 may be provided with more than three chambers. Further, the third passage 208 is not limited to include the rotational axis line of the crank shaft 125, namely the third passage 208 may be disposed at an eccentric position which is eccentric to the rotational axis line. Further, the third passage 208 may be inclined to the rotational axis line.

In the first embodiment and the second embodiment described above, the inner communicating opening 191, 201 are disposed respectively at a side surface of the motor shaft 111, the crank shaft 125 as a rotational member, however it is not limited to such composition. Namely, the inner communicating opening 191, 201 may be disposed at the end of the rotational shaft of the rotational member such that the inner communicating opening 191, 201 are eccentrically located to the rotational axis. In this way, since the inner communicating opening 191, 201 are eccentrically located to the rotational axis, in accompany with the rotation of the rotational member, the position of the inner communicating opening 191, 201 are changed. Therefore, the lubricant is prevented from flowing into the air passage 193, 203 through the inner communicating opening 191, 201.

Further, in the first embodiment and the second embodiment, the motor shaft 111 of the driving motor 110, and the crank shaft 125 and the driven gear 123 are defined as the rotational member, however other rotational member may be utilized as the rotational member. Namely, the air communicating part 190, 200 may be disposed on the first intermediate shaft 163, the second intermediate shaft 153 or the tool holder 159 which is adapted to rotate. Further, the air communicating part 190, 200 may be disposed on a movable member other than the rotational member as long as the position of the inner communicating opening 191, 201 is adapted to be changed in accompany with the driving of the hammer drill 100. Namely, the air communicating par 190, 200 may be disposed on the movable member such as the connecting rod 129 or the piston 131 which moves in the longitudinal direction of the hammer bit 119. Further, the outer communicating opening 192, 202 is communicated with the outer air such that the air inside the gear housing space 105*a* is communicated with the outside via the air passage 193, 203 disposed inside the movable member. In this case, the connecting rod 129 or the piston 131 is one example of a feature corresponding to "a movable member" and/or "a movable shaft" on the invention alternatively.

(Third Embodiment)

Figure 7:
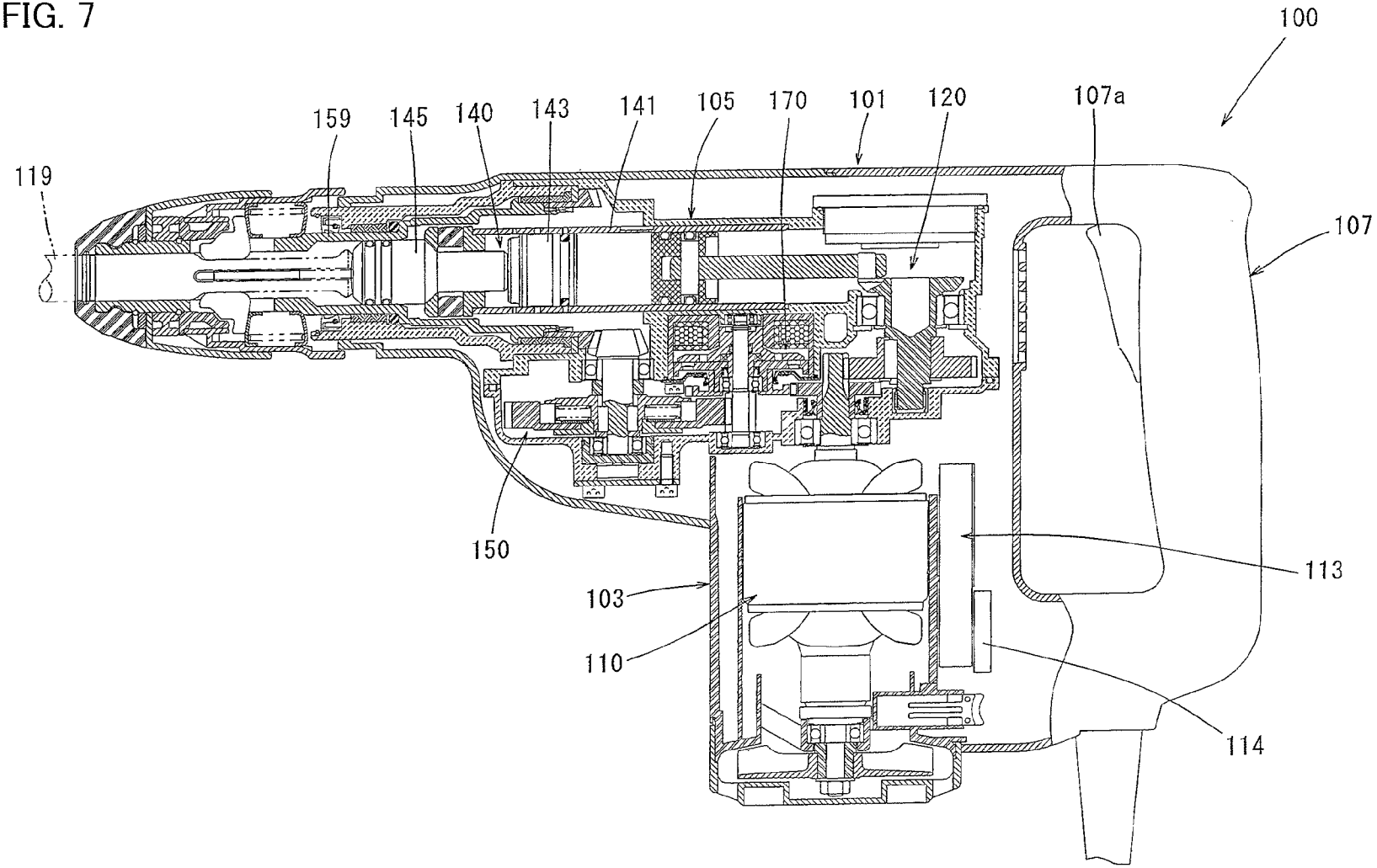
FIG. 7 shows a cross-sectional view of a total composition of a hammer drill in accordance with a third embodiment of the invention.
Figure 8:
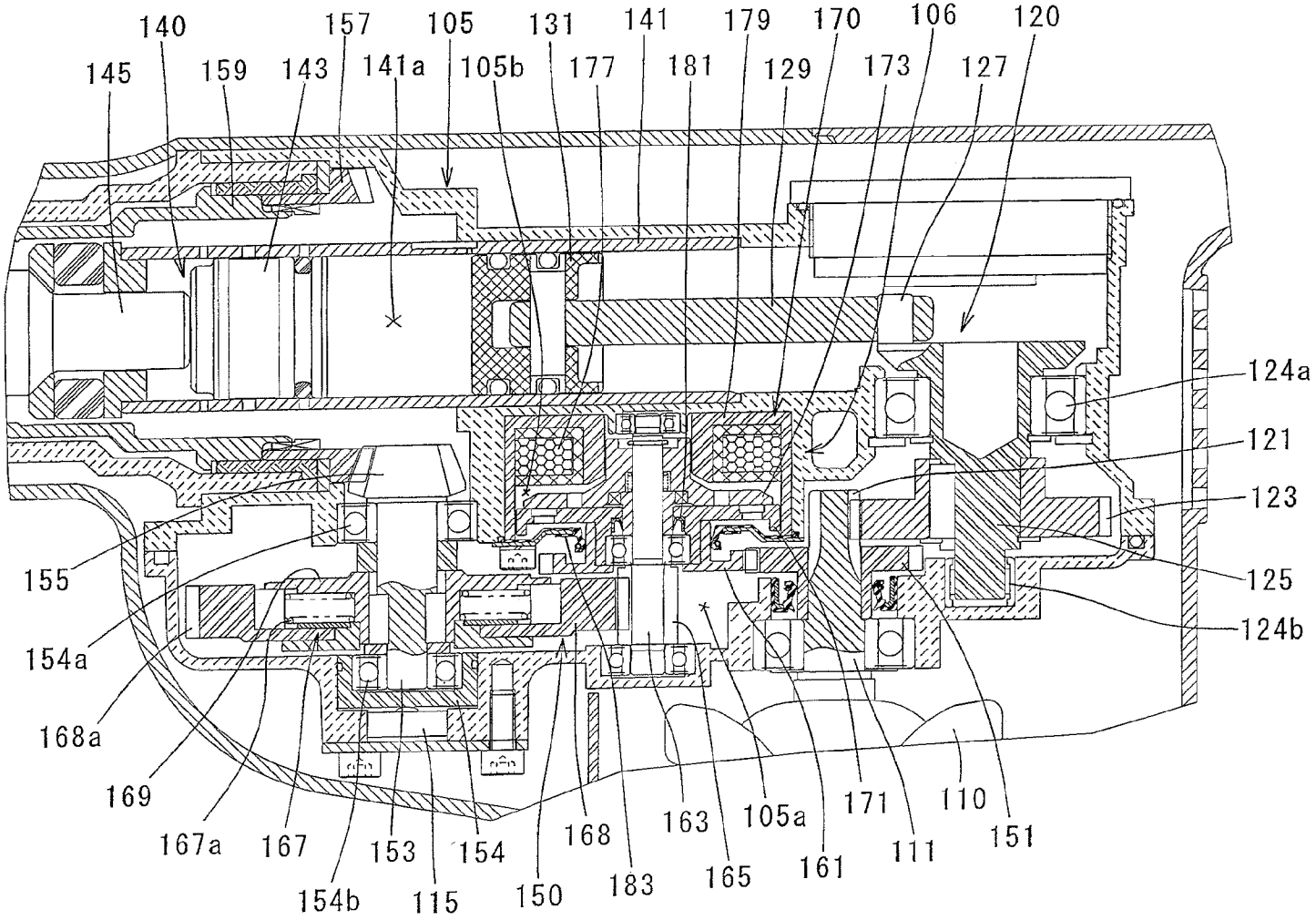
FIG. 8 shows an enlarged cross-sectional view of a main part of the hammer drill.

A third embodiment of the invention will be explained with reference to FIG. 7 to FIG. 11. As shown in FIG. 7 and FIG. 8, the air communicating part is not provided in the third embodiment. Namely, the gear housing space 105*a* is provided as an air tight space by the gear housing 105. The composition other than the air communicating part is similar to the composition of the first and the second embodiment, therefore the composition is signed same number as the first and the second embodiment and the explanation of the composition is omitted.

As shown in FIG. 8, in case that the electromagnetic clutch 170 is housed in a clutch housing space 105*b*, the lubricant may flow into the clutch housing space 105*b* through interspaces which are provided between the first intermediate shaft 163 and the driving clutch member 171 which are relatively rotatable to each other, as well as between the driving clutch member 171 and the inner housing portion 106. Therefore, in the third embodiment, by providing a first oil sealing member 181 and a second oil sealing member 182 are disposed at respective interspaces, the lubricant is prevented from entering into the clutch housing space 105*b* in the gear housing space 105*a*.

Figure 9:
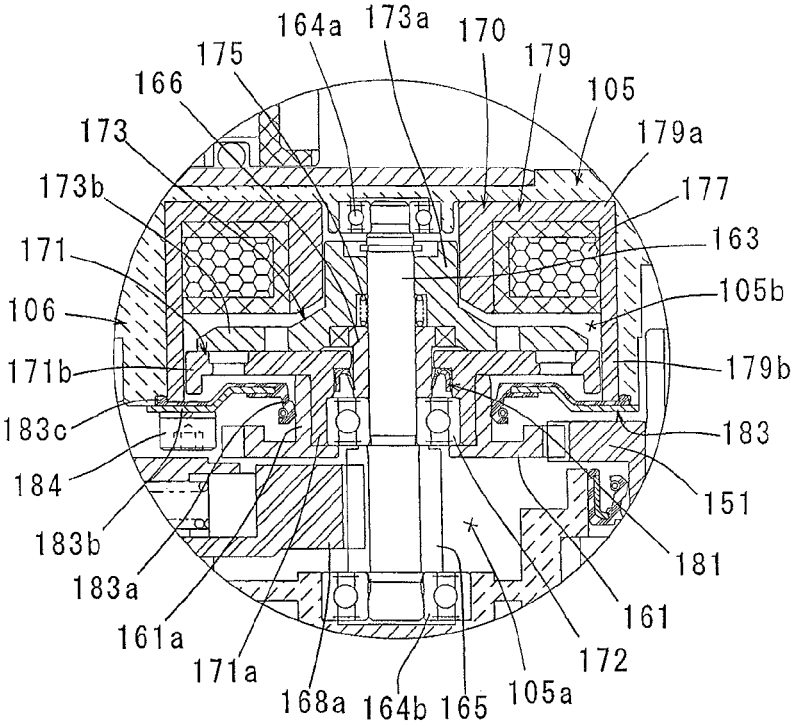
FIG. 9 shows an enlarged cross-sectional view of an electromagnetic clutch while transmitting a torque.

As shown in FIG. 9, the driving clutch member 171 includes a cylindrical boss portion 171*a* which protrudes downward. The boss portion 171*a* is disposed on the first intermediate shaft 163 via a bearing 172 such that the driving clutch member 171 is relatively rotatable to the first intermediate shaft 163 in the circumferential direction of the first intermediate shaft 163. A boss portion 161*a* of the first intermediate gear 161 is fixed on the periphery of the boss portion 171*a*. Therefore, the driving clutch member 171 is adapted to rotate integrally with the first intermediate gear 161. Namely, the torque of the driving motor 110 is inputted to the electromagnetic clutch 170 via the first intermediate gear 161.

On the other hand, as shown in FIG. 9, the driven clutch member 173 includes a cylindrical boss portion 173*a* which protrudes upward. The boss portion 173*a* is disposed so as to be relatively displaceable to the first intermediate shaft 163 in the longitudinal direction of the first intermediate shaft 163. Further, the boss portion 173*a* is disposed so as to be rotated integrally with the first intermediate shaft 163. Accordingly, the driven clutch member 173 is relatively rotatable against the driving clutch member 171 and relatively displaceable in the longitudinal direction of the first intermediate shaft 163. In this way, the first intermediate shaft 163, which rotates integrally with the boss portion 173*a* of the driven clutch member 173, and the boss portion 171*a* of the driving clutch member 171 are disposed coaxially. Further, the first intermediate shaft 163 which rotates integrally with the driven clutch member 173 is disposed at inner side of the boss portion 171*a* of the driving clutch member 171 in the radial direction.

The driving clutch member 171 includes a disc portion 171*b* which protrudes from the periphery of the boss portion 171*a* in the radial direction. Likewise, the driven clutch member 173 includes a disc portion 173*b* which protrudes from the periphery of the boss portion 173*a* in the radial direction. The disc portion 171*b*, 173*b* are disposed to face to each other. Further, the driven clutch member 173 is always biased by a spring 175 such that the disc portion 173*b* of the driven clutch member 173 is separated from the disc portion 171*b* of the driving clutch member 171.

The spring 175 is disposed at outside of the first intermediate shaft 163 between the sleeve 166 into which the first intermediate shaft 163 is pressed and the boss portion 173*a* of the driven clutch member 173, so as to contact with the longitudinal upper end of the sleeve 166 and the lower end of the boss portion 173*a*. A coil housing member 179 which houses the electromagnetic coil 177 is disposed at upper area of the disc portion 173*b* of the driven clutch member 173. The coil housing member 179 includes a ring-shaped coil housing portion 179*a* which housing the electromagnetic coil 177 and a cylindrical portion 179*b* which protrudes downward form the periphery of the coil housing portion 179*a*. Further, the boss portion 173*a* of the driven clutch member 173 is disposed in a central hole of the coil housing portion 179*a* such that an interspace is provided between the central hole and the boss portion 173*a*. At inner space of the cylindrical portion 179*b*, the disc portion 171*b* of the driving clutch member 171 and the disc portion 173*b* of the driven clutch member 173 are provided so as to provide an interspace between the disc portion 171*b* and the disc portion 173*b*.

The electromagnetic clutch 170 described above, by providing or interrupting a current to the electromagnetic coil 177 based on an order from a controller 113, the driven clutch member 173 is moved in the longitudinal direction of the first intermediate shaft 163. As shown in FIG. 9, by contacting with the disc portion 171*b*, 173*b* to each other, the torque is transmitted by means of the friction force on the contact face. On the other hand, as shown in FIG. 10, by canceling the contact with the disc portion 171*b*, 173*b*, the transmission of the torque is interrupted.

As described above, the electromagnetic clutch 170 is constructed such that an engagement portion between the second driving gear 151 and the first intermediate gear 161 for inputting the torque into the driving clutch member 171, and an engagement portion between the second intermediate gear 165 and the third intermediate gear 168*a* for outputting the torque from the driven clutch member 173 are disposed at same side (one side) of the contact face between the driving clutch member 171 and the driven clutch member 173 with respect to a direction crossing the contact face.

As shown in FIG. 8, the second intermediate gear 165 is disposed at lower end portion in the longitudinal direction of the first intermediate shaft 163. Further, the torque of the driven clutch member 173 is transmitted from the second intermediate gear 165 to the mechanical torque limiter 167 via the third intermediate gear 168*a* which meshes with the second intermediate gear 165. Namely, in the third embodiment, the first intermediate shaft 163 is defined as an output shaft of the electromagnetic clutch 170.

Figure 10:
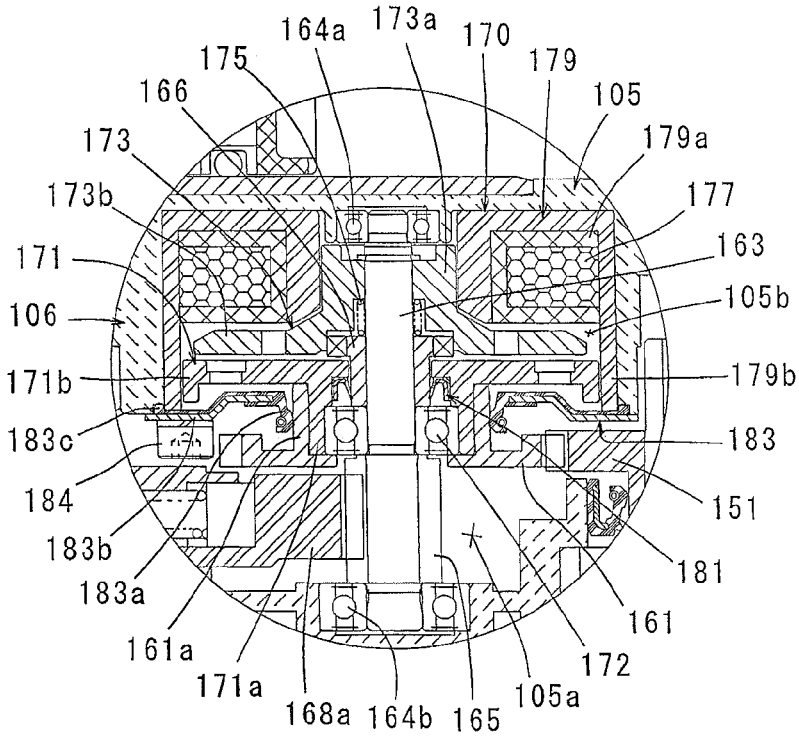
FIG. 10 shows an enlarged cross-sectional view of the electromagnetic clutch while interrupting a transmission of the torque.

As shown in FIG. 9 and FIG. 10, the clutch housing space 105*b* is mainly formed by the inner housing portion 106 inside the gear housing 105. The inner housing portion 106 is adapted to protrude downwardly from the inner wall of the gear housing 105, and the inner housing portion 106 is formed as a substantially cylindrical member in which the lower part of the inner housing portion 106 is opened downwardly.

The coil housing member 179 which housed the electromagnetic coil 177, the driven clutch member 173, and the driving clutch member 171 are disposed in the clutch housing space 105*b*. The coil housing member 179 is inserted at inner space of the inner housing portion 106. The lower end of the cylindrical portion 179*b* is positioned at substantially same position as the lower end of the inner housing portion 106. The driven clutch member 173 and the driving clutch member 171 are disposed at inner space of the cylindrical portion 179*b*. Further, the lower part of the first intermediate shaft 163 which is defined as the output shaft rotating integrally with the driven clutch member 173, and the lower part of the boss portion 171*a* of the driving clutch member 171 defined as the input shaft are disposed so as to protrude downwardly from the clutch housing space 105*b*.

Figure 11:
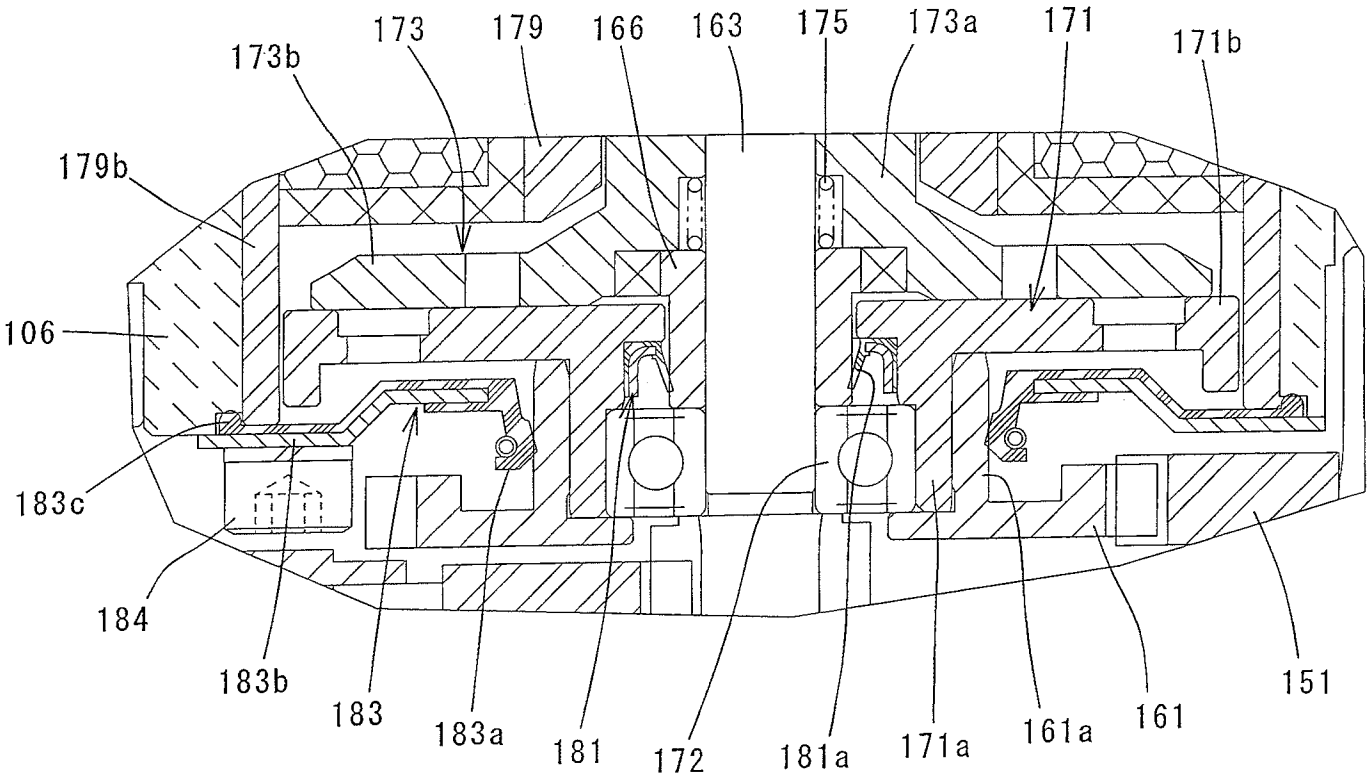
FIG. 11 shows an enlarged cross-sectional view around an oil sealing member.

As shown in FIG. 11, the first oil sealing member 181 is disposed between the first intermediate shaft 163 and the boss portion 171*a* of the driving clutch member 171. The first oil sealing member 181 is provided with a combination of a metal ring and a rubber, and is formed as a ring-shaped member. The first oil sealing member 181 is disposed at upper side (a side of the clutch housing space 105*b*) of the bearing 172 which is disposed between the first intermediate shaft 163 and the boss portion 171*a* of the driving clutch member 171. The metal ring as an outer side member is pressed into the inner surface of the boss portion 171*a* of the driving clutch member 171. A lip portion 181*a* of the rubber as an internal side member is disposed elastically to be tightly sealed to a periphery of the first intermediate shaft 163, i.e. a periphery of the sleeve 166 which is fixed on the periphery of the first intermediate shaft 163.

Further, the second oil sealing member 182 is disposed between the boss portion 171*a* of the driving clutch member 171 and the inner housing portion 106. The second oil sealing member 182 is provided as a substantially disc-shaped sealing member which includes a cylindrical portion 183*a* at the center part of the second oil sealing member 183. The cylindrical portion 183*a* is provided with a combination of a metal ring and a rubber. The inner periphery of the cylindrical portion 183*a* is disposed elastically to be tightly sealed to a periphery of the boss portion 161*a* of the first intermediate gear 161 which is fixed on the boss portion 171*a* of the driving clutch member 171. The disc portion 183*b* of the second oil sealing member 183 is provided with a combination of a rubber and a metal disk. A O-ring 183 is integrally disposed with the outer part of the rubber of the disc portion 183*b*. The O-ring 183*c* is disposed tightly with the lower end of the inner housing portion 106.

Further, the second oil sealing member 183 is fixed on the inner housing portion 106 by screws 184 at a plurality of parts in the circumference direction, thereby the O-ring 183*c* is disposed to be tightly sealed against the inner housing portion 106. Further, the second oil sealing member 183 is disposed such that the rubber of the disc portion 183*b* at the inner part of the O-ring 183*c* contacts with the lower end of the cylindrical portion 179*b* of the coil housing member 179, thereby the rubber pushes the cylindrical portion 179*b* upwardly. Therefore, the coil housing member 179 is fixed in the inner housing portion 106. Namely, the coil housing member 179 is prevented from rotating integrally with the driving clutch member 171 and/or the driven clutch member 173.

Further, as shown in FIG. 8, the power transmission mechanism 150 includes a load-cell 115 which detects the torque exerted on the hammer bit 119. The load-cell 115 is provided fixedly such that the load-cell 115 faces a longitudinal end surface of a bearing cover 154 which houses the lower bearing 154*b* on the second intermediate shaft 153 and contacts with the bearing cover 154. When the torque of the driving motor 110 is transmitted to the hammer bit 119, a axial force and a radial force is exerted on the small bevel gear 155 by engagement with the large bevel gear 157. The axial force and the radial force is exerted on the second intermediate shaft 153 which is integrated with the small bevel gear 155 as a thrust load and a radial load respectively. The thrust load is detected by the load-cell 115 as a strain-gauged sensor. And then the torque condition of the hammer bit 119 is detected by the detected thrust load.

Further, as shown in FIG. 7 and FIG. 8, a velocity sensor (or acceleration sensor) 114 for detecting the motion condition of the body 101 around the longitudinal direction of the hammer bit 119 is attached on the controller 113. Since the velocity sensor 114 is attached on the controller 113, a distance between the velocity sensor 114 and the controller 113 is shortened thereby the electrical connection is simplified. Further, the attached position of the velocity sensor 114 is not limited on the controller 113. The attached position of the velocity sensor 114 may be as long as a position which moves integrally with the body 101. Further, for the purpose of detecting precisely the velocity, the position at which the velocity sensor 114 is disposed is preferred that the velocity sensor 114 is disposed as far from the rotational axis line of the hammer bit 119 as possible with respect to a direction crossing the rotational axis line.

The torque detected by the load-cell 115 is outputted to the controller 113. Further, the velocity detected by the velocity sensor 114 is also outputted to the controller 113. In case that the torque detected by the load-cell 115 exceeds the predetermined torque value and the velocity detected by the velocity sensor 114 exceeds the predetermined velocity value, the controller 113 outputs a current interrupting signal which interrupts the current provision to the electromagnetic coil 177 of the electromagnetic clutch 170, thereby the controller 113 interrupts the transmission of the torque by means of the electromagnetic clutch 170. Further, the predetermined torque value is preferable to be selectively changeable based on a manual operation by which a torque adjustment mechanism such as a dial and so on is operated by a user. Further, the torque adjusted by the torque adjustment mechanism is limited to be less than the maximum torque of the mechanical torque limiter 169 defined by the spring 167*a*.

According to the third embodiment, in case that the hammer bit 119 is inadvertently locked by being caught by a workpiece during the hammer drill operation and that the torque value detected by the load-cell 115 exceeds the predetermined torque value and the velocity value detected by the velocity sensor 114 exceeds the predetermined velocity value, the controller 113 outputs the current interrupting signal thereby the current provision to the electromagnetic coil 177 is interrupted. Therefore, the disc portion 173*b* of the driven clutch member 173 is moved and separated from the disc portion 171*b* of the driving clutch member 171 by means of the biasing force of the spring 175. Namely, the electromagnetic clutch 170 is switched from a torque transmitting mode to a torque interrupting mode, the transmission of the torque from the driving motor 110 to the hammer bit 119 is interrupted. As a result, when the hammer bit 119 is locked by a workpiece, the body 101 is forcibly rotated by the excessive reaction torque exerted on the body 101.

Further, according to the third embodiment, the first oil sealing member 181 and the second oil sealing member 182 are disposed at the clutch housing space 105*b* which is divided from the gear housing space 105*a*. Therefore, an interspace (gap) between the clutch housing space 105*b* and the gear housing space 105*a* is sealed completely. Namely, the clutch housing space 105*b* is disposed as a hermetically sealed space which is separated from the lubricant in the gear housing space 105*a*. Therefore, the lubricant is prevented from adhering at the contact face between the disc portion 171*b* of the driving clutch member 171 and the disc portion 173*b* of the driven clutch member 173. Especially, according to the hammer drill 100, while the hammer drill 100 is working, the pressure inside the gear housing space 105*a* becomes high-pressure because of the heat generated by the driving mechanism such as the motion converting mechanism 120, the impact element 140 and the power transmission mechanism 150 and so on. Accordingly, the first oil sealing member 181 and the second oil sealing member 183 respectively have a function of pressure resistance.

Further, according to the third embodiment, the O-ring 183*c* is disposed integrally with the second oil sealing member 183, and the lower end of the inner housing portion 106 is pushed elastically by the O-ring 183*c*. Therefore the sealing quality at the lower end of the inner housing portion 106 is improved.

Further, according to the third embodiment, the coil housing member 179 is pushed upwardly against the clutch housing space 105*b* by pushing the lower end of the cylindrical portion 179*b* of the coil housing member 179 elastically by means of the elasticity of the rubber of the second oil sealing 183. Therefore, the coil housing member 179 is fixed on the inner housing portion 106, the coil housing member 179 is regulated to rotate with the driving clutch member 171 or the driven clutch member 173. Namely, the second oil sealing member 183 prevents the coil housing member 179 from rotating with a rotational member. As a result, it is not necessary to add another member for regulating the coil housing member 179 to rotate with a rotational member, thereby the number of the component of the hammer drill 100 is reduced.

Further, according to the third embodiment, the boss portion 171*a* of the driving clutch member 171 and the first intermediate shaft 163 which is disposed integrally with the boss portion 173*a* of the driven clutch member 173 are disposed coaxially to each other, and the first intermediate shaft 163 is disposed at inner side of the boss portion 171*a* in the radial direction. In this way, an input part which inputs the torque to the electromagnetic clutch 170 and an output part to which the electromagnetic clutch outputs the torque are disposed at same side (lower side) of the contact face of the electromagnetic clutch 170. Therefore, a size of the electromagnetic clutch 170 in a longitudinal direction (vertical direction) is shortened. Accordingly, the electromagnetic clutch 170 is disposed to be close to the motion axis line (impact axis line) of the striker 143. As a result, the moment generated when the hammer drill 100 is forcibly inadvertently rotated during the hammer drill operation is reduced.

In the third embodiment, the transmission of the torque by the electromagnetic clutch 170 is interrupted based on both of the torque detected by the load-cell 115 and the velocity detected by the velocity sensor 114, however the transmission of the torque by the electromagnetic clutch 170 may be interrupted based on either one of the detected value among the torque and the velocity.

(Fourth Embodiment)

A fourth embodiment of the invention will be explained with reference to FIG. 12 and FIG. 13. In the fourth embodiment, the first intermediate gear 161 which engages and meshes with the second driving gear 151 is disposed so as to rotate integrally with the first intermediate shaft 163. Namely, in the fourth embodiment, the first intermediate shaft 163 is defined as an input shaft. Other components are similar to the components in the third embodiment, therefore the same numbers are signed on the components and the explanation of the components is omitted.

Figure 12:
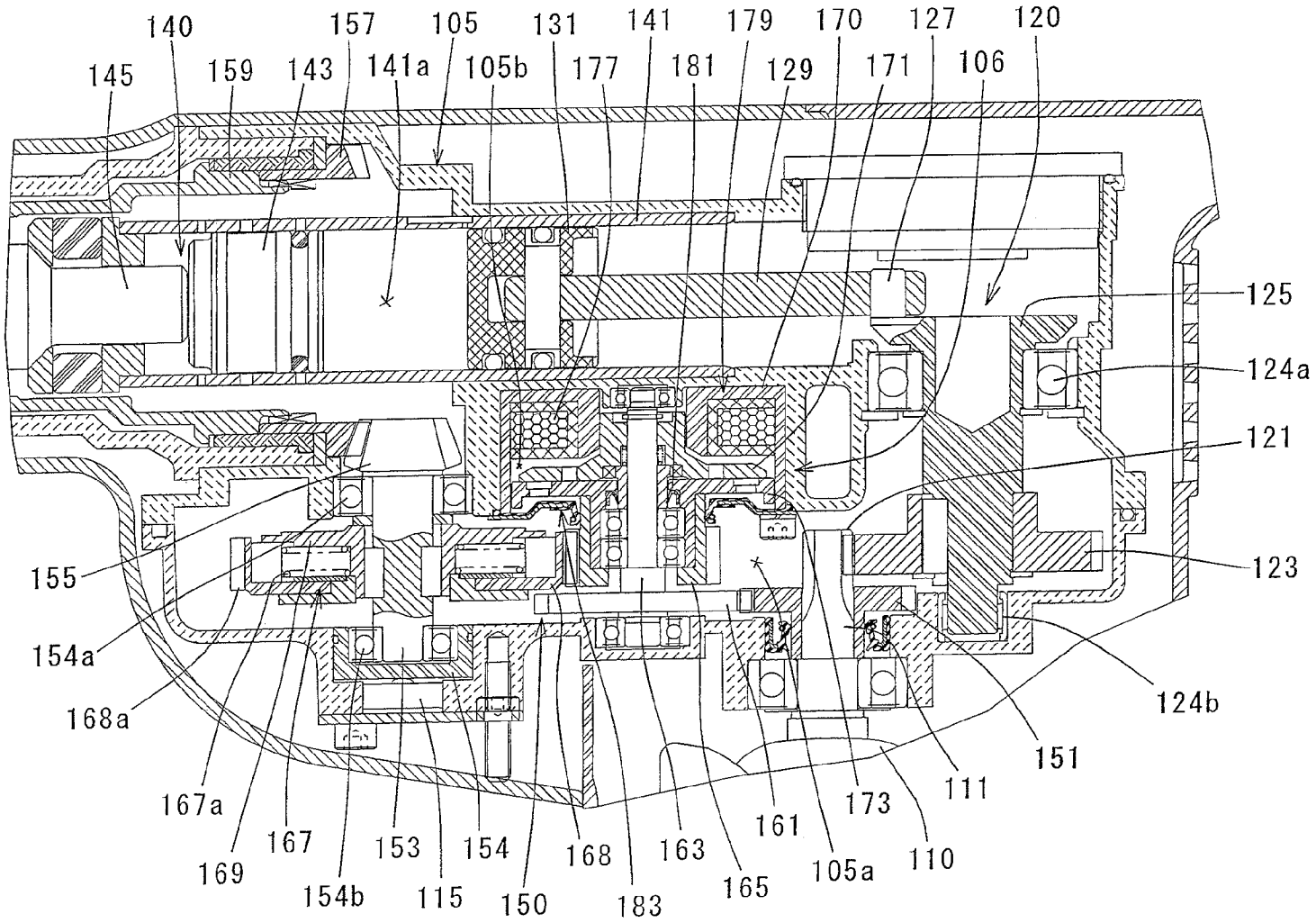
FIG. 12 shows an enlarged cross-sectional view of a main part of the hammer drill in accordance with a fourth embodiment.
Figure 13:
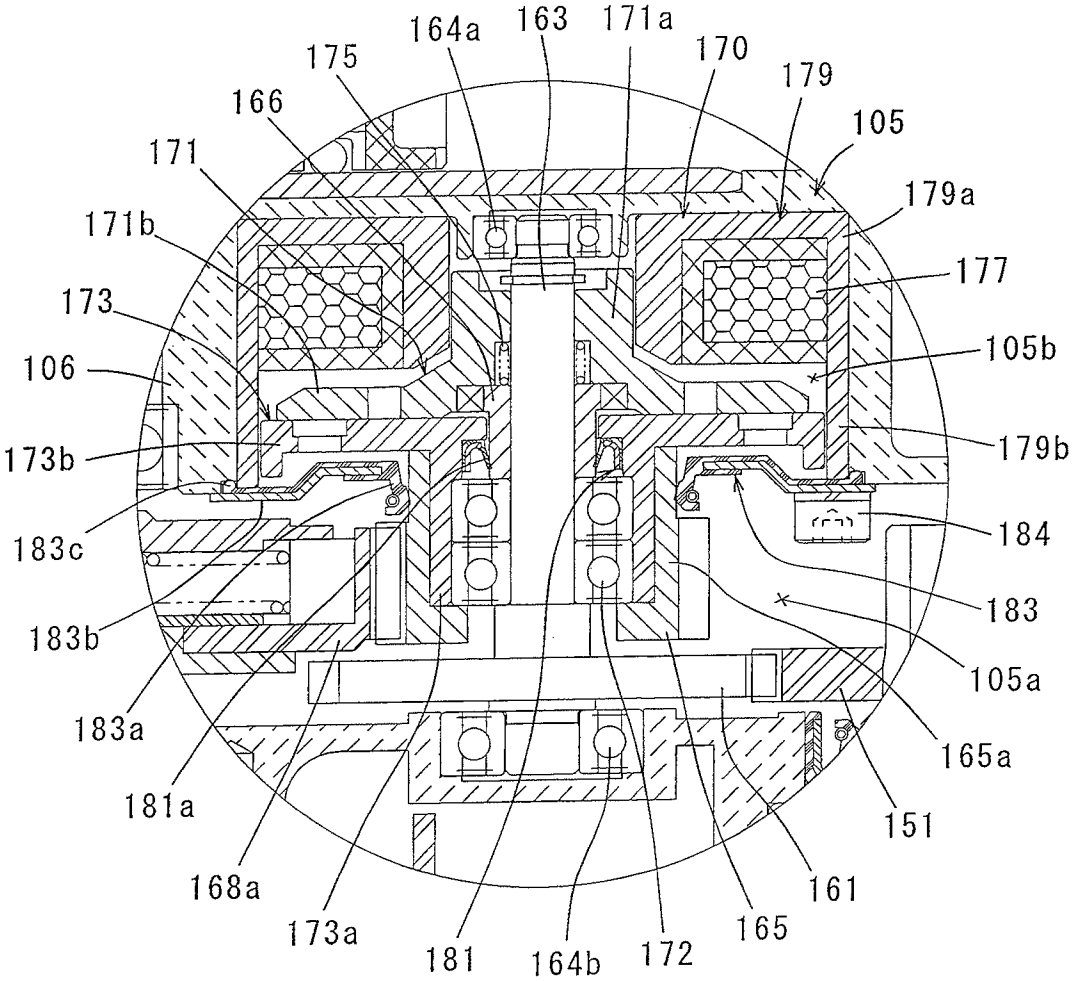
FIG. 13 shows an enlarged cross-sectional view of an electromagnetic clutch while transmitting a torque in accordance with the fourth embodiment.

As shown in FIG. 12 and FIG. 13, according to the fourth embodiment, the driving clutch member 171 is disposed so as to rotate integrally with the first intermediate shaft 163, and the driven clutch member 173 is disposed so as to be relatively rotatable via the bearing 172 against the first intermediate shaft 163. Further, the boss portion 165*a* of the second intermediate gear 165 which engages and the meshes with the third intermediate gear 168*a* of the mechanical torque limiter 167, is disposed and fixed on the boss portion 173*a* of the driven clutch member 173. Namely, in the fourth embodiment, the first intermediate shaft 163 and the boss portion 173*a* of the driven clutch member 173 are disposed coaxially to each other, and the first intermediate shaft 163 as an input shaft is disposed at an inner side of the driven clutch member 173 as an output shaft. In other words, the composition of the input shaft and the output shaft of the fourth embodiment is opposite to the third embodiment.

Further, the boss portion 171*a* of the driving clutch member 171 is disposed to be relatively movable in the longitudinal direction of the first intermediate shaft 163. Namely, the driving clutch member 171 is moved in the longitudinal direction of the first intermediate shaft 163 by off and on of the current provision to the electromagnetic coil 177. And the torque is transmitted by means of the friction force of the contact face between the disc portion 171*b* of the driving clutch member 171 and the disc portion 173*b* of the driven clutch member 173. On the other hand, the transmission of the torque is interrupted by cancelling the contact of the contact face.

The first oil sealing member 181 is disposed between the first intermediate shaft 163 and the boss portion 173*a* of the driven clutch member 173. Further, the second oil sealing member 183 is disposed between the boss portion 165*a* of the second intermediate gear 165 and the inner housing portion 106. Further, the first oil sealing member 181 and the second oil sealing member 183 are similar to them of the third embodiment.

According to the fourth embodiment described above, the similar effect to the third embodiment is achieved.

In the first to fourth embodiment, as to the electromagnetic clutch 170, a disc clutch in which includes the flat disc portion 171*b*, 173*b* is utilized to explain, however for example a cone clutch in which a contact face is formed as a circular cone shape may be applied to the invention. Further, as to the electromagnetic clutch 170, the torque may be transmitted not only by the friction force but by an engagement of tooth members.

In the first to fourth embodiment described above, as to one example of the power tool, the electrical hammer drill is utilized to explain, however as long as the power tool has a driving mechanism chamber, other than the hammer drill may be applied to the invention. For example, an electrical disk grinder, a screw fastening tool, a circular sawing tool and so on may be applied to the invention. Especially, according to the circular sawing tool, in case that a rotating circular saw is locked by being caught by a workpiece and then a kick-back of the power tool in which the tool body is inadvertently rotated in an opposite direction opposed to a rotating direction of the circular saw, the electromagnetic clutch 170 is useful for regulating the kick back of the power tool.

Having regard to an aspect of the invention, following features are provided:

(Feature 1)

A power tool which actuates a tool being attachable to the power tool, comprising:

a driving mechanism which is adapted to actuate the tool and has a movable member including a movable shaft;

a driving mechanism chamber which houses the driving mechanism; and a lubricant which is provided inside the driving mechanism chamber for lubricating the driving mechanism, wherein the movable member includes a first opening, a second opening and a passage which connects the first opening and the second opening, thereby the passage communicates with an inner space of the driving mechanism chamber via the first opening and further communicates with an outer space of the driving mechanism chamber via the second opening, and wherein at least a part of the passage is arranged inside the movable member.

(Feature 2)

A power tool configured to rotationally drive a tool, the power tool comprising:

a motor;

a power transmission mechanism configured to be driven by the motor, the power transmission mechanism configured to rotationally drive the tool;

a driving mechanism chamber which houses the power transmission mechanism;

an electrical wiring configured to provide current to the motor;

an outer housing configured to house at least a part of the driving mechanism chamber and an electrical contact configured to connect the motor and the electrical wiring; and a lubricant for lubricating the power transmission mechanism, which is provided inside the driving mechanism chamber, wherein the power transmission mechanism includes an electromagnetic clutch configured to transmit power and interrupt a power transmission from the motor to the tool based on a driving status of the power tool, and wherein the electromagnetic clutch is provided with a driving rotational member and a driven rotational member configured to rotate about a clutch axis, the electromagnetic clutch configured to transmit power by engaging the driving rotational member and the driven rotational member to each other and to interrupt the power transmission by cancelling an engagement among the driving rotational member and the driven rotational member, and wherein an engagement region of the driving rotational member and the driven rotational member is provided inside the driving mechanism chamber being separated from the lubricant by a sealing member.

DESCRIPTION OF NUMERALS

100 hammer drill
101 body
103 motor housing
105 gear housing
105*a* gear housing space
105*b* clutch housing space
106 inner housing portion
107 hand grip
110 driving motor
111 motor shaft
113 controller
114 velocity sensor
115 load-cell
119 hammer bit
120 motion converting mechanism
121 first driving gear
123 driven gear
124*a*, 124*b* bearing
125 crank shaft
127 eccentric shaft
129 connecting rod
131 piston
140 impact element
141 cylinder
141*a* air chamber
143 striker
145 impact bolt
150 power transmission mechanism
151 second driving gear
153 second intermediate shaft
154 bearing cover
154*a*, 154*b* bearing
155 small bevel gear
157 large bevel gear
159 tool holder
161 first intermediate gear
161*a* boss portion
163 first intermediate shaft
164*a*, 164*b* bearing
165 second intermediate gear
165*a* boss portion
166 sleeve
167 mechanical torque limiter
167*a* spring
168 driving member
168*a* third intermediate gear
169 driven member
170 electromagnetic clutch
171 driving clutch member
171*a* boss portion
171*b* disc portion
173 driven clutch member
173*a* boss portion
173*b* disc portion
175 spring
177 electromagnetic coil
179 coil housing member
179*a* coil housing portion
179*b* cylindrical portion
181 first oil sealing member
181*a* lip portion
183 second oil sealing member
183*a* cylindrical portion
183*b* disc portion
184 screw
190 air communicating part
191 inner communicating opening
192 outer communicating opening
193 air passage
194 axially extending part
195 radially extending part
196 outer air communicating chamber
197 third oil sealing member
200 air communicating part
201 inner communicating opening
202 outer communicating opening
203 air passage
204 first chamber

205 second chamber
206 first passage
207 second passage
208 third passage
209 outer air communicating chamber
210 filter
211 fourth oil sealing member

What is claimed is:

1. A power tool configured to actuate a tool being attachable to the power tool, comprising:

a driving mechanism which is adapted to actuate the tool, the driving mechanism configured with a rotational member including a rotational shaft;

a driving mechanism chamber, the driving mechanism chamber defining an inner space which houses the driving mechanism; and a lubricant which is provided in the inner space of the driving mechanism chamber for lubricating the driving mechanism, wherein the rotational member includes a first opening, a second opening and a passage which connects the first opening and the second opening, thereby the passage communicates with the inner space of the driving mechanism chamber via the first opening and further communicates with an outer space of the driving mechanism chamber via the second opening, wherein at least a part of the passage is arranged inside the rotational shaft, wherein a part of the passage extends in a radial direction of the rotational member and connects to the first opening, wherein a part of the passage extends inside the rotational shaft in an axial direction of the rotational shaft and connects to the second opening, and wherein the second opening opens in an end face of the rotational shaft in the axial direction.

2. The power tool according to claim 1, wherein the passage connects to the second opening such that the passage is arranged to include an axis line of the rotational shaft and to extend to be parallel to the axis line.

3. The power tool according to claim 1, wherein the driving mechanism includes a motor and a driven member which is driven by the motor, and wherein the rotational member is defined by the driven member.

4. The power tool according to claim 3, wherein the driving mechanism includes a crank mechanism which converts a rotational motion of the driving shaft of the motor to a linear motion, and wherein the driven member is defined by a crank shaft of the crank mechanism.

5. The power tool according to claim 1, wherein the passage is provided with a plurality of chambers connected to one another.

6. The power tool according to claim 1, wherein the rotational member is provided with an internal chamber located along the passage and configured to store a predetermined volume of lubricant while allowing pressurized gases from within the driving mechanism chamber to escape past the predetermined volume of lubricant via the second opening.

7. The power tool according to claim 1, wherein the driving mechanism includes a motor and an electromagnetic clutch which is disposed between the motor and the tool, the electromagnetic clutch being adapted to interrupt a power transmission from the motor to the tool based on a driving status of the power tool.

8. A power tool configured to actuate a tool being attachable to the power tool, comprising:

a driving mechanism which is adapted to actuate the tool, the driving mechanism configured with a motor including a driving shaft;

a driving mechanism chamber, the driving mechanism chamber defining an inner space which houses the driving mechanism;

an outside communicating chamber which is provided at a distal end area of the driving shaft such that the outside communicating chamber is separated from the driving mechanism chamber and is communicated with the outside of the driving mechanism chamber; and a lubricant which is provided in the inner space of the driving mechanism chamber for lubricating the driving mechanism, wherein the motor includes a first opening, a second opening and a passage which connects the first opening and the second opening, thereby the passage communicates with the inner space of the driving mechanism chamber via the first opening and further communicates with an outer space of the driving mechanism chamber via the second opening, wherein at least a part of the passage extends inside the driving shaft of the motor and connects to the second opening, and wherein the second opening opens in a distal end face of the driving shaft and is communicated with the outside communicating chamber.

9. A power tool configured to rotationally drive a tool, the power tool comprising:

a motor;

a power transmission mechanism configured to be driven by the motor, the power transmission mechanism configured to rotationally drive the tool;

a driving mechanism chamber which houses the power transmission mechanism; and a lubricant for lubricating the power transmission mechanism, which is provided inside the driving mechanism chamber, wherein the power transmission mechanism includes an electromagnetic clutch configured to transmit power and interrupt a power transmission from the motor to the tool based on a driving status of the power tool, wherein the electromagnetic clutch is provided with a driving rotational member and a driven rotational member, the electromagnetic clutch being adapted to transmit power by engaging the driving rotational member and the driven rotational member to each other and to interrupt the power transmission by cancelling an engagement among the driving rotational member and the driven rotational member, wherein an engagement region of the driving rotational member and the driven rotational member, the engagement region which is provided inside the driving mechanism chamber being separated from the lubricant by a sealing member, wherein the electromagnetic clutch includes an input shaft to which power of the motor is inputted and an output shaft which outputs the power toward the tool, the input shaft and the output shaft being arranged coaxially, wherein both of a power input part which inputs the power to the input shaft and a power output part which outputs the power from the output shaft are arranged at one side of a line perpendicular to an axial line of the input shaft and the output shaft with respect to the engagement region, and wherein the sealing member is arranged at a position between the input shaft and the output shaft, as well as at a position between one component being arranged at an outside position among the input shaft and the output shaft and an inside wall of the driving mechanism chamber.

10. The power tool according to claim 9, wherein the input shaft is provided as another shaft from a motor shaft of the driving motor, and defined as an intermediate shaft which is arranged between the motor shaft and the tool.

11. The power tool according to claim 9 wherein the output shaft is arranged at the inside of the input shaft with respect to a radial direction of the input shaft.

12. The power tool according to claim 9, wherein the electromagnetic clutch has a field which houses an electromagnetic coil therein, and wherein the inside wall is adapted to prevent the field from rotating with the electromagnetic clutch while the electromagnetic clutch is transmitting the power.

13. The power tool according to claim 9, wherein the tool is defined as a bit being elongated and being rotatable around a longitudinal direction of the bit, and wherein the electromagnetic clutch is adapted to prevent the power tool from being swung inadvertently around the longitudinal direction by interrupting the power transmission in a state that the bit is locked by a workpiece.

14. The power tool according to claim 13, wherein the electromagnetic clutch is adapted to interrupt the power transmission in a state that a torque applying to the bit and/or a velocity or an acceleration applying to a body of the power tool is not less than a predetermined threshold.

* * * * *